US011149411B2

(12) United States Patent
Edamura et al.

(10) Patent No.: US 11,149,411 B2
(45) Date of Patent: Oct. 19, 2021

(54) WORK MACHINE

(71) Applicant: HITACHI CONSTRUCTION MACHINERY CO., LTD., Tokyo (JP)

(72) Inventors: Manabu Edamura, Kasumigaura (JP); Shiho Izumi, Hitachinaka (JP); Hiroshi Sakamoto, Hitachi (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 233 days.

(21) Appl. No.: 16/486,847

(22) PCT Filed: Mar. 12, 2018

(86) PCT No.: PCT/JP2018/009368
§ 371 (c)(1),
(2) Date: Aug. 19, 2019

(87) PCT Pub. No.: WO2019/175917
PCT Pub. Date: Sep. 19, 2019

(65) Prior Publication Data
US 2020/0277758 A1 Sep. 3, 2020

(51) Int. Cl.
*E02F 9/26* (2006.01)
*E02F 3/32* (2006.01)
*E02F 5/14* (2006.01)

(52) U.S. Cl.
CPC ..... *E02F 9/261* (2013.01); *E02F 9/264* (2013.01); *E02F 3/32* (2013.01); *E02F 5/145* (2013.01)

(58) Field of Classification Search
CPC . E02F 3/32; E02F 3/437; E02F 9/2285; E02F 9/2296; E02F 9/261; E02F 9/262; E02F 9/264; E02F 9/265
See application file for complete search history.

(56) References Cited

U.S. PATENT DOCUMENTS 9,026,319 B2 * 5/2015 Hayashi ..... E02F 3/845 701/50
9,605,412 B2 * 3/2017 Ikegami ..... E02F 9/2228
(Continued)

FOREIGN PATENT DOCUMENTS

CN 103422531 A 12/2013
CN 104246085 A 12/2014
(Continued)

OTHER PUBLICATIONS

International Search Report of PCT/JP2018/009368 dated Jun. 5, 2018.
(Continued)

*Primary Examiner* — Tyler J Lee
(74) *Attorney, Agent, or Firm* — Mattingly & Malur, PC

(57) ABSTRACT

A controller (40) of a hydraulic excavator (1) includes: a first distance calculation section (43*f*) calculating a first distance D1 that is a distance between a bucket toe and a target surface on a virtual straight line Lv extended vertically from the bucket toe, based on position information on the bucket toe and position information on the target surface (700); and a second distance calculation section (43*g*) calculating a second distance D2 that is a distance between the target surface and a current landform on the virtual straight line Lv, based on the position information on the bucket toe and the position information on the target surface and position information on the current landform 800. A display device (53*a*) displays the first distance D1 and the second distance D2.

7 Claims, 20 Drawing Sheets

(56) References Cited

U.S. PATENT DOCUMENTS

| | | | | |
|---|---|---|---|---|
| 9,677,251 | B2 * | 6/2017 | Kitajima | E02F 3/439 |
| 9,856,628 | B2 * | 1/2018 | Kitajima | E02F 3/435 |
| 2005/0027420 | A1 * | 2/2005 | Fujishima | E02F 9/2045 701/50 |
| 2013/0158797 | A1 * | 6/2013 | Fukano | E02F 9/264 701/36 |
| 2014/0100712 | A1 | 4/2014 | Nomura et al. | |
| 2014/0180444 | A1 | 6/2014 | Edara et al. | |
| 2014/0200776 | A1 * | 7/2014 | Matsuyama | E02F 9/264 701/50 |
| 2015/0019086 | A1 * | 1/2015 | Hayashi | E02F 3/844 701/50 |
| 2016/0024757 | A1 | 1/2016 | Nomura et al. | |
| 2016/0122969 | A1 * | 5/2016 | Noborio | E02F 3/7613 701/50 |
| 2017/0175364 | A1 | 6/2017 | Hasegawa et al. | |
| 2019/0330825 | A1 * | 10/2019 | Tanimoto | B60K 35/00 |
| 2019/0360179 | A1 * | 11/2019 | Moriki | E02F 3/435 |

FOREIGN PATENT DOCUMENTS

| | | | |
|---|---|---|---|
| JP | 2006-200185 | A | 8/2006 |
| JP | 2013-113044 | A | 6/2013 |
| JP | 2017-186875 | A | 10/2017 |
| JP | 2017-210729 | A | 11/2017 |
| KR | 10-2011-0110648 | A | 10/2011 |
| KR | 10-1144727 | B1 | 5/2012 |
| KR | 10-2014-0088043 | A | 7/2014 |
| WO | 2016/111148 | A1 | 7/2016 |

OTHER PUBLICATIONS

International Preliminary Report on Patentabiliry received in corresponding International Application No. PCT/JP2018/009368 dated Sep. 24, 2020.

Korean Office Action received in corresponding Korean Application No. 10-2019-7024481 dated Oct. 5, 2020.

Japanese Office Action received in corresponding Japanese Application No. 2019-546426 dated Aug. 4, 2020.

Chinese Office Action received in corresponding Chinese Application No. 201880013175.2 dated Apr. 25, 2021.

* cited by examiner

DISPLAY EXAMPLE 1 OF PERIPHERAL EXCAVATION DEPTH (FOURTH DISTANCE)

DISPLAY EXAMPLE 2 OF PERIPHERAL EXCAVATION DEPTH (FOURTH DISTANCE)

WORK MACHINE

TECHNICAL FIELD

The present invention relates to a work machine.

BACKGROUND ART

A work machine having a work implement (front work implement), represented by a hydraulic excavator, has the work implement driven when an operation lever is operated by an operator, and adjusts a landform for construction into a desired shape. As a technology for the purpose of assisting such a work, there is machine guidance (MG). The MG is a technology in which the positional relation between a target surface representing a desired shape of a surface for construction and the work implement is displayed on a screen of a display device, whereby assistance to the operator's operation at the time of forming the target surface by the work implement is realized.

The MG includes a technology in which a current landform inclusive of a landform formed by excavation by the work implement (this landform may be referred to as "formed shape") is displayed in addition to the positional relation of the target surface and the work implement. For example, Patent Document 1 discloses a formed shape information processing device for a construction machine in which information on a formed shape formed by excavation by a work implement is acquired based on measurement results of a three-dimensional position of a monitor point preliminarily set in the work implement. The formed shape information processing device is provided with working state determining means for determining whether or not the working state of the work implement is in an excavation work state. When it is determined by the determining means that the working state of the work implement is in the excavation work state, information on the formed shape is acquired based on the measurement results of the three-dimensional position of the monitor point.

PRIOR ART DOCUMENT

Patent Document

Patent Document 1: JP-2006-200185-A

SUMMARY OF THE INVENTION

Problem to be Solved by the Invention

Incidentally, in the past, since a finishing stake and a leveling string for indicating the shape of a target surface have been disposed in a site, it has been comparatively easy for an operator to grasp where the target surface is present in relation to the actual landform, and in what extent the actual landform should be excavated to reach the target surface. In the MG, on the other hand, although the need for the finishing stake and the leveling string is eliminated, only information indicating the positional relation between the target surface and the work implement is displayed on a display screen of a display device. The information on the display in the MG includes the distance between the target surface and the toe of a bucket, but does not include the distance from the current landform to the target surface. Therefore, it is difficult for the operator to intuitively grasp by what extent of excavation of the current landform the target surface can be reached, or at what extent of speed the work implement should be operated from the viewpoint of enhancement of working efficiency and prevention of damaging of the target surface.

Patent Document 1 discloses a technology for updating the data of the current landform (formed shape) by use of the trajectory of a monitor point (for example, the toe of the bucket) of the work implement, and an example of simultaneously displaying the target surface and the current landform is disclosed in FIG. 7. However, this technology merely updates the data of the current landform with the trajectory of the toe, and does not display the distance between the target surface and the current landform. Therefore, it is difficult for the operator to intuitively grasp by what extent more excavation of the current landform the target surface can be reached, and the like.

Note that even in the existing MG of displaying the distance from the toe of the bucket to the target surface, if the toe of the bucket is made to stand still in the state of making contact with the current landform, the distance between the current landform and the target surface can be essentially displayed. However, if this operation is conducted each time of excavation work, the working efficiency would be lowered conspicuously. Specifically, when excavation is started from a posture in which the toe is put in contact with the current landform, the excavation power may become insufficient, and an operation of again separating the toe once put in contact with the current landform from the current landform for the purpose of securing excavation power is needed.

It is an object of the present invention to provide a work machine capable of informing an operator of at what position relative to a current landform a target surface is present.

Means for Solving the Problem

The present application includes a plurality of means for solving the above-mentioned problem. One example of the plurality of means is a work machine including: a work implement; a controller including a storage section in which position information on an arbitrarily set target surface is stored, and a reference point position calculation section that calculates position information on a reference point arbitrarily set in the work implement; and a display device that displays a positional relation between the target surface and the work implement based on the position information on the target surface and the position information on the reference point. Position information on a current landform is stored in the storage section, the controller further includes: a first distance calculation section calculating a first distance that is a distance between the reference point and the target surface on a virtual straight line extended in a predetermined direction from the reference point toward the target surface, based on the position information on the reference point and the position information on the target surface; and a second distance calculation section calculating a second distance that is a distance between the target surface and the current landform on the virtual straight line, based on the position information on the reference point and the position information on the target surface and the position information on the current landform, and the first distance and the second distance are displayed on the display device.

Advantage of the Invention

According to the present invention, the distance between the current landform and the target surface can be grasped by referring to the second distance displayed on the display device. Therefore, even in the case where the work implement is located remote from the current landform, the operator can easily grasp at around what place the target surface is present, and at what extent of speed the work implement should be operated.

MODES FOR CARRYING OUT THE INVENTION

Figure 1:
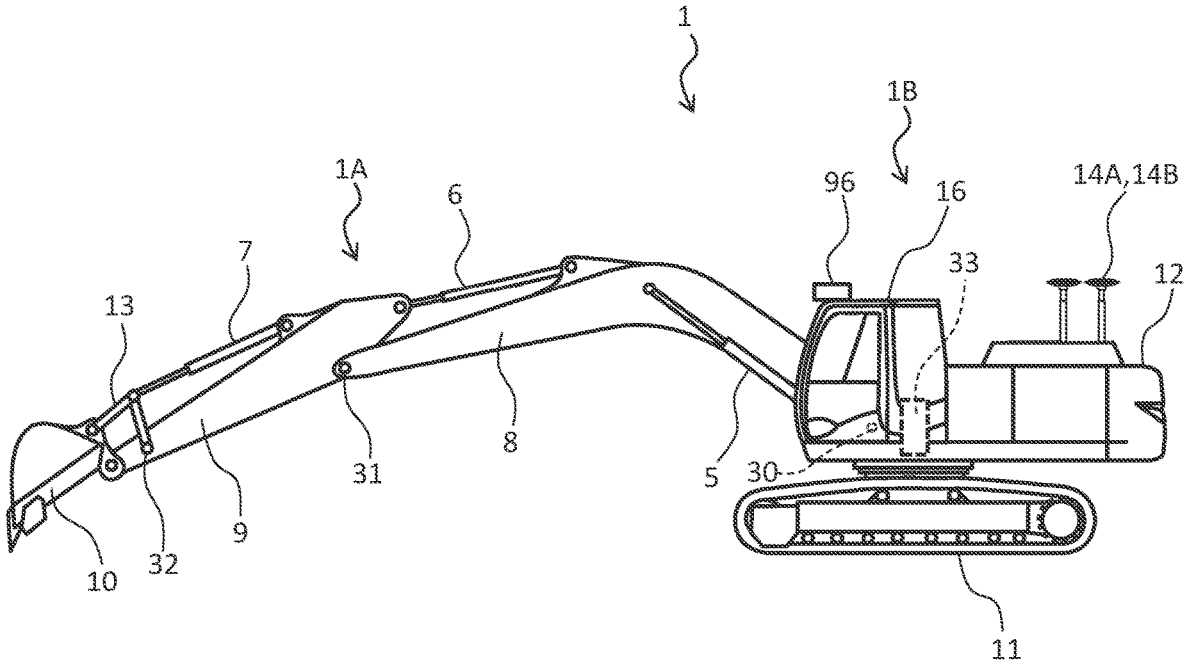
FIG. 1 is a configuration view of a hydraulic excavator according to an embodiment of the present invention.

Embodiments of the present invention will be described below referring to the drawings. Note that a hydraulic excavator including a bucket 10 as a work tool (attachment) at a tip of a work implement will be depicted as an example in the following description, the present invention may be applied to a work machine including an attachment other than the bucket. Further, the present invention is applicable also to work machines other than the hydraulic excavator, insofar as the work machines have a work implement configured by linking a plurality of link members (attachment, arm, boom, etc.).

In addition, as for the meanings of the terms "on," "on an upper side" or "on a lower side" used together with a term (for example, a target surface, a design surface, etc.) indicating a certain shape herein, "on" means on a "surface" of the certain shape, "on an upper side" means "a position above the surface" of the certain shape, and "on a lower side" means "a position below the surface" of the certain shape. Besides, in the following description, in the case where a plurality of the same component elements are present, reference characters (numerals) may be added an alphabet at the tail thereof, and the plurality of component elements may be collectively expressed by omitting the alphabet. For example, where three pumps 300*a*, 300*b*, and 300*c* are present, they may be collectively expressed as the pumps 300.

First Embodiment

—General Configuration of Hydraulic Excavator—

Figure 2:
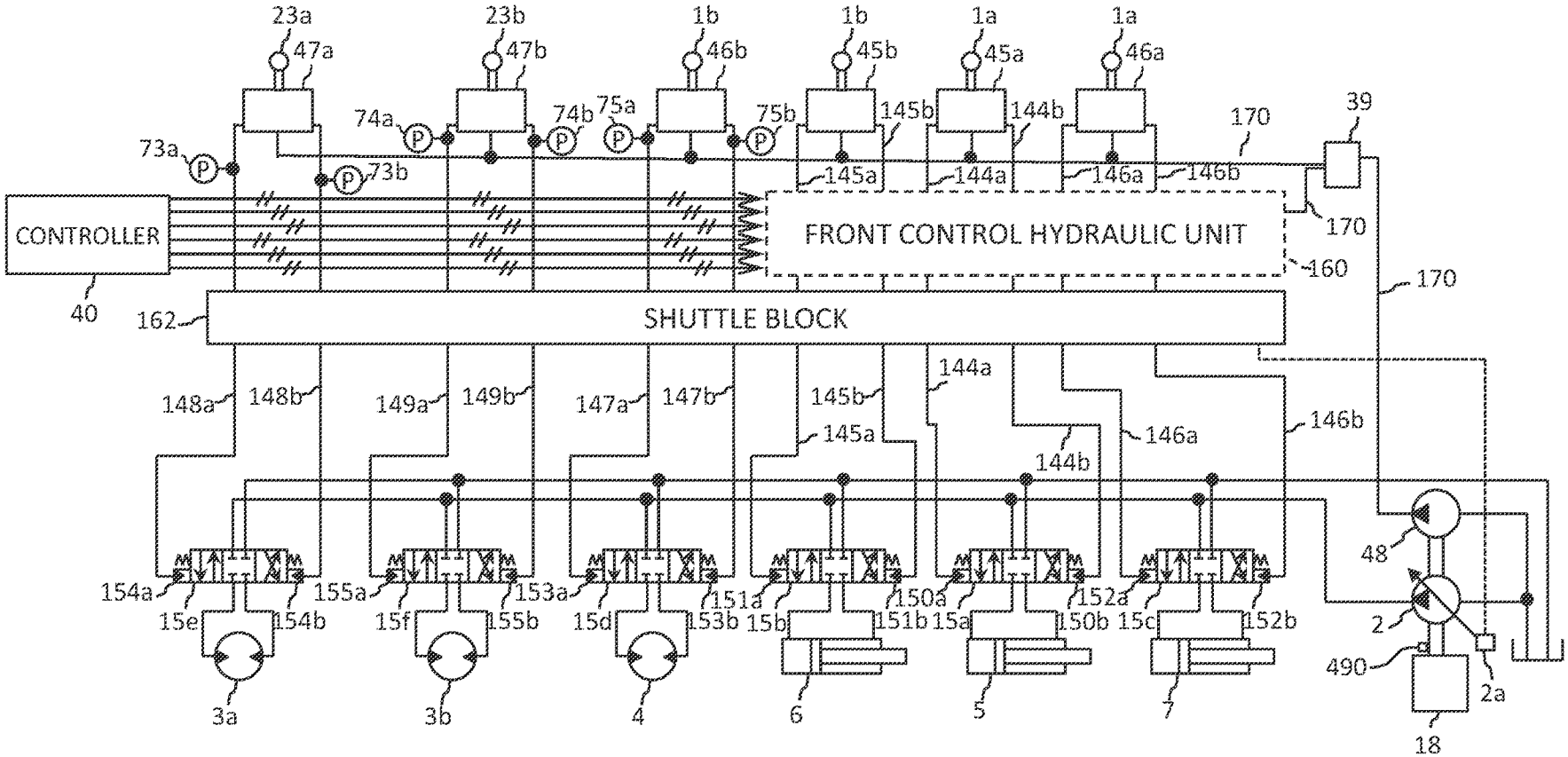
FIG. 2 is a figure depicting a controller of the hydraulic excavator according to the embodiment of the present invention together with a hydraulic drive system.

FIG. 1 is a configuration view of a hydraulic excavator according to a first embodiment of the present invention, and FIG. 2 is a figure depicting a controller of the hydraulic excavator according to the first embodiment of the present invention together with a hydraulic drive system.

In FIG. 1, a hydraulic excavator 1 includes an articulated type front work implement 1A, and a machine body 1B. The machine body 1B includes a lower track structure 11 traveling by left and right track hydraulic motors 3*a* and 3*b* (for the hydraulic motor 3*a*, see FIG. 2), and an upper swing structure 12 mounted onto the lower track structure 11 and turned by a swing hydraulic motor 4.

The front work implement 1A is configured by linking a plurality of driven members (a boom 8, an arm 9, and a bucket 10) respectively rotated in the vertical direction. A base end of the boom 8 is rotatably supported on a front portion of the upper swing structure 12 through a boom pin. The arm 9 is rotatably linked to a tip of the boom 8 through an arm pin, and the bucket 10 is rotatably linked to a tip of the arm 9 through a bucket pin. The boom 8 is driven by a boom cylinder 5, the arm 9 is driven by an arm cylinder 6, and the bucket 10 is driven by a bucket cylinder 7.

In order that rotational angles α, β, and γ (see FIG. 3) of the boom 8, the arm 9, and the bucket 10 can be measured, a boom angle sensor 30 is attached to the boom pin, an arm angle sensor 31 is attached to the arm pin, and a bucket angle sensor 32 is attached to a bucket link 13. A machine body tilting angle sensor (for example, inertia measuring unit (IMU)) 33 for detecting a tilting angle θ (see FIG. 3) of the upper swing structure 12 (machine body 1B) relative to a reference plane (for example, a horizontal plane) is mounted to the upper swing structure 12. Note that the angle sensors 30, 31, and 32 can be replaced respectively by angle sensors (for example, inertia measuring units (IMU)) relative to the reference plane (for example, a horizontal plane).

In a cabin 16 provided on the upper swing structure 12, there are disposed an operation device 47*a* (FIG. 2) having a track right lever 23*a* (FIG. 2) and used for operating a track right hydraulic motor 3*a* (lower track structure 11), an operation device 47*b* (FIG. 2) having a track left lever 23*b* (FIG. 2) and used for operating a track left hydraulic motor 3*b* (lower track structure 11), operation devices 45*a* and 46*a* (FIG. 2) sharing an operation right lever 1*a* (FIG. 2) and used for operating the boom cylinder 5 (boom 8) and the bucket cylinder 7 (bucket 10), and operation devices 45*b* and 46*b* (FIG. 2) sharing an operation left lever 1*b* (FIG. 2) and used for operating the arm cylinder 6 (arm 9) and the swing hydraulic motor 4 (upper swing structure 12). In the following, the track right lever 23*a*, the track left lever 23*b*, the operation right lever 1*a*, and the operation left lever 1*b* may be generically referred to as the operation levers 1 and 23.

An engine 18 as a prime mover mounted on the upper swing structure 12 drives a hydraulic pump 2 and a pilot pump 48. The hydraulic pump 2 is a variable displacement pump the displacement of which is controlled by a regulator 2*a*, whereas the pilot pump 48 is a fixed displacement pump. In the present embodiment, as depicted in FIG. 2, a shuttle block 162 is provided in the course of pilot lines 144, 145, 146, 147, 148, and 149. Hydraulic pressure signals outputted from the operation devices 45, 46, and 47 are inputted also to the regulator 2*a* through the shuttle block 162. While a detailed configuration of the shuttle block 162 is omitted, a hydraulic pressure signal is inputted through the shuttle block 162 to the regulator 2*a*, and the delivery rate of the hydraulic pump 2 is controlled according to the hydraulic pressure signal.

A pump line 170 as a delivery line of the pilot pump 48 is passed through a lock valve 39 of a pump line 170, and is thereafter branched into a plurality of lines, which are connected to each of valves in the operation devices 45, 46, and 47 and a front control hydraulic unit 160. The lock valve 39 is a solenoid selector valve in this example, and its solenoid drive section is electrically connected to a position sensor of a gate lock lever (not illustrated) disposed in the cabin 16 of the upper swing structure 12. The position of the gate lock lever is detected by the position sensor, from which a signal according to the position of the gate lock lever is inputted to the lock valve 39. When the position of the gate lock lever is in a locking position, the lock valve 39 is closed, and the pump line 170 is interrupted, and when it is in an unlocking position, the lock valve 39 is opened, and the pump line 170 is opened. Specifically, in a state in which the pump line 170 is interrupted, operations by the operation devices 45, 46, and 47 are invalidated, and operations such as swing and excavation are inhibited.

The operation devices 45, 46, and 47 are of a hydraulic pilot system, and generate pilot pressures (which may be referred to as operation pressures) according to operation amounts (for example, lever strokes) and operation directions of the operation levers 1 and 23 operated by the operator, based on a hydraulic fluid delivered from the pilot pump 48. The pilot pressures thus generated are supplied to hydraulic drive sections 150*a* to 155*b* of corresponding flow control valves 15*a* to 15*f* (see FIG. 2) in a control valve unit (not illustrated) via pilot lines 144*a* to 149*b* (see FIG. 3), and are utilized as control signals for driving these flow control valves 15*a* to 15*f*.

The hydraulic fluid delivered from the hydraulic pump 2 is supplied to the track right hydraulic motor 3*a*, the track left hydraulic motor 3*b*, the swing hydraulic motor 4, the boom cylinder 5, the arm cylinder 6, and the bucket cylinder 7 via the flow control valves 15*a*, 15*b*, 15*c*, 15*d*, 15*e*, and 15*f*. The boom cylinder 5, the arm cylinder 6, and the bucket cylinder 7 are extended or contracted by the hydraulic fluid thus supplied, whereby the boom 8, the arm 9, and the bucket 10 are rotated, and the position and posture of the bucket 10 are changed. In addition, the swing hydraulic motor 4 is rotated by the hydraulic fluid supplied, whereby the upper swing structure 12 is swung relative to the lower track structure 11. Besides, the track right hydraulic motor 3*a* and the track left hydraulic motor 3*b* are rotated by the hydraulic fluid supplied, whereby the lower track structure 11 is made to travel.

Figure 3:
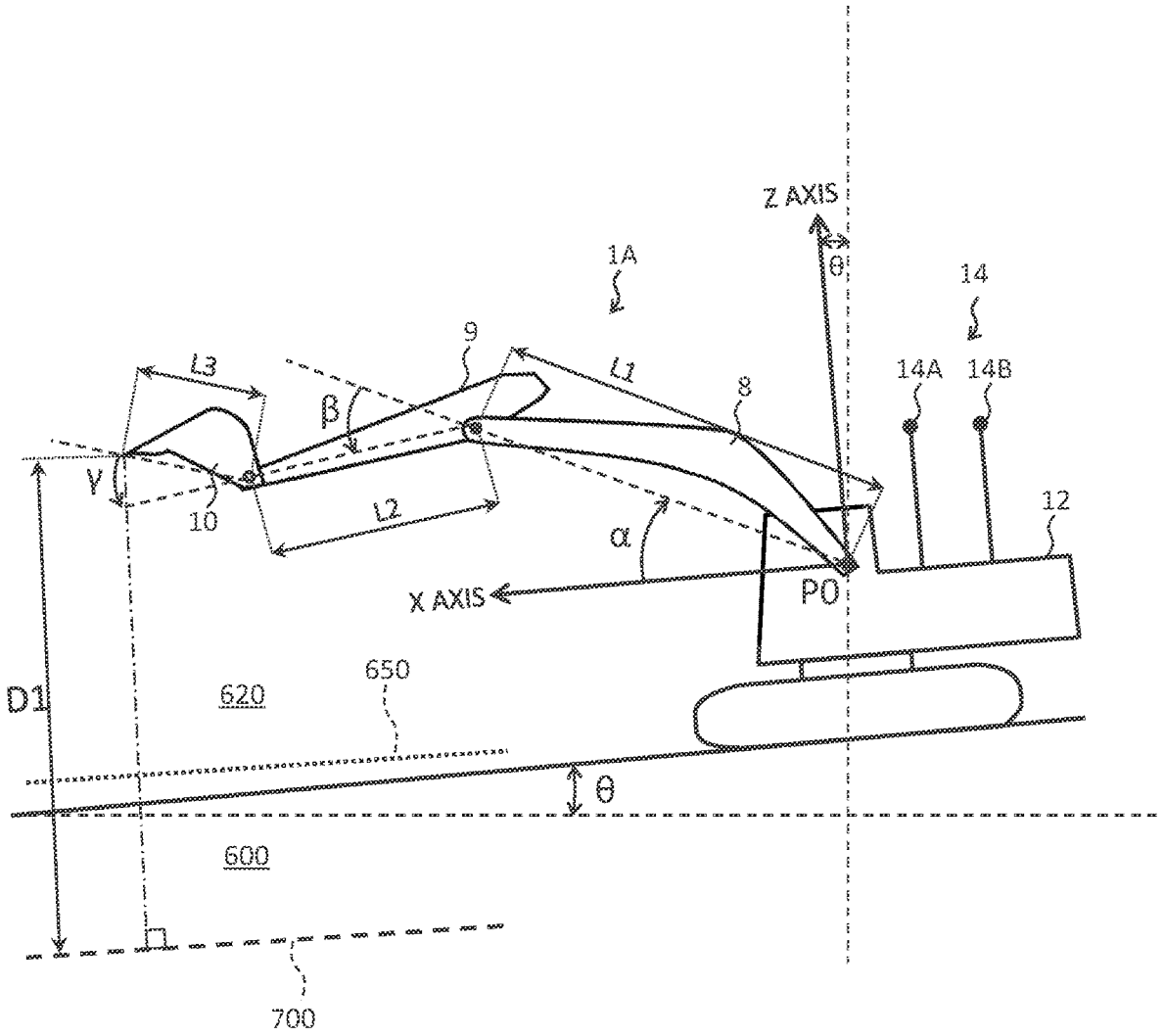
FIG. 3 is a figure depicting a coordinate system in the hydraulic excavator of FIG. 1 and a target surface.

The posture of the work implement 1A can be defined based on an excavator coordinate system (local coordinate system) of FIG. 3. The excavator coordinate system of FIG. 3 is a coordinate system set on the upper swing structure 12, in which a base portion of the boom 8 is made to be an origin PO, a Z axis is set in the vertical direction of the upper swing structure 12, and an X axis is set in the horizontal direction of the upper swing structure 12. In addition, a direction defined in a right hand system by the X axis and the Z axis is made to be a Y axis. A tilting angle of the boom 8 relative to the X axis was made to be boom angle α, a tilting angle of the arm 9 relative to the boom was made to be arm angle β, and a tilting angle of the bucket toe relative to the arm was made to be bucket angle γ. A tilting angle of the machine body 1B (upper swing structure 12) relative to a horizontal plane (reference plane) was made to be tilting angle θ. The boom angle α is detected by a boom angle sensor 30, the arm angle β by an arm angle sensor 31, the bucket angle γ by a bucket angle sensor 32, and the tilting angle θ is detected by a machine body tilting angle sensor 33. The boom angle α is minimized when the boom 8 is raised to a maximum (highest) (when the boom cylinder 5 is at a stroke end in a raising direction, that is, when the boom cylinder length is at a longest), and is maximized when the boom 8 is lowered to a minimum (lowest) (when the boom cylinder 5 is at a stroke end in a lowering direction, that is, when the boom cylinder length is at a shortest). The arm angle β is minimized when the arm cylinder length is at a shortest, and is maximized when the arm cylinder length is at a longest. The bucket angle γ is minimized when the bucket cylinder length is at a shortest (as denoted in FIG. 3), and is maximized when the bucket cylinder length is at a longest. In this instance, let the length from the base portion of the boom 8 to a connection portion for connection with the arm 9 be L1, let the length from a connection portion between the arm 9 and the boom 8 to a connection portion between the arm 9 and the bucket 10 be L2, and let the length from the connection portion between the arm and the bucket 10 to a tip portion of the bucket 10 be L3, then the tip position of the bucket 10 in the excavator coordinate system can be represented by the following formulas (1) and (2), where $X_{bk}$ is an X-directional position, and $Z_{bk}$ is a Z-directional position.

$$X_{bk}=L_1\cos(\alpha)+L_2\cos(\alpha+\beta)+L_3\cos(\alpha+\beta+\gamma) \quad \text{formula (1)}$$

$$Z_{bk}=L_1\sin(\alpha)+L_2\sin(\alpha+\beta)+L_3\sin(\alpha+\beta+\gamma) \quad \text{formula (2)}$$

In addition, as depicted in FIG. 1, the hydraulic excavator 1 includes a pair of GNSS (Global Navigation Satellite System) antennas 14A and 14B on the upper swing structure 12. Though not illustrated, the antennas 14A and 14B incorporate GNSS receivers, and, by use of positioning signals from positioning satellites, the respective positions of the GNSS antennas 14A and 14B can be determined. In other words, by use of the two antennas 14, the orientation of the machine body can be determined. The GNSS receivers may be connected separately. Based on information from the GNSS antennas 14, the position and orientation of the hydraulic excavator 1 in the global coordinate system can be calculated. Besides, by use of the formulas (1) and (2) and the tilting angle θ together with this, the position of the toe of the bucket 10 in the global coordinate system can be calculated. In the present embodiment, these functions of the GNSS receivers are mounted in the controller 40, and a work machine position calculation section 43*e* that will be described later corresponds to this.

Figure 4:
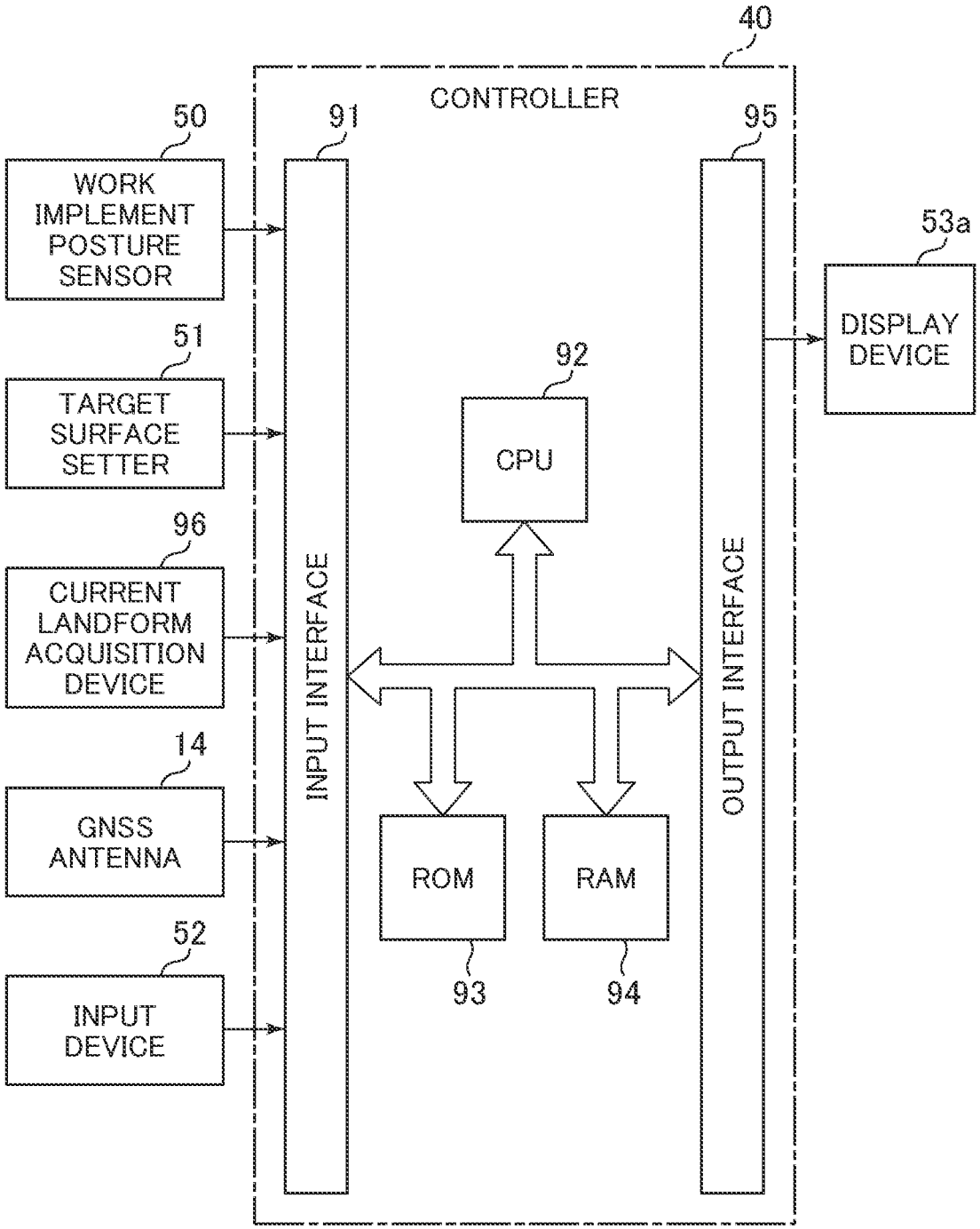
FIG. 4 is a hardware configuration diagram of a controller 40 of the hydraulic excavator.
Figure 7:
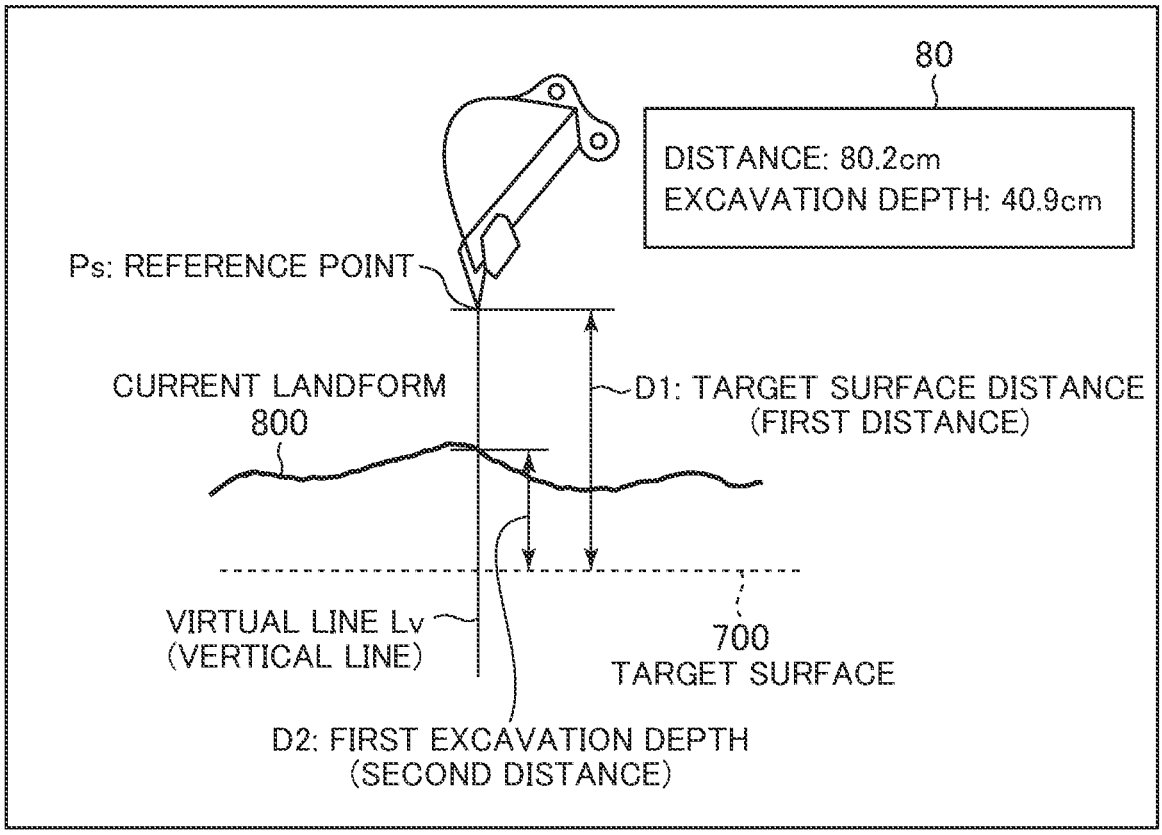
FIG. 7 is an example of a display screen of a display device 53*a* of the first embodiment.

FIG. 4 is a configuration diagram of an MG system possessed by the hydraulic excavator according to the present embodiment. As MG for the front work implement 1A in the present system, for example, as depicted in FIG. 7, a treatment of assisting an operator's operation by displaying a positional relation between a target surface 700 arbitrarily set for an excavation work by a hydraulic excavator 1111 and the work implement 1A (for example, the bucket 10) on a display device 53*a* is conducted.

The system of FIG. 4 includes a work implement posture sensor 50, a target surface setter 51, the display device 53*a* disposed in the cabin 16 and capable of displaying the positional relation between the target surface 700 and the work implement 1A, a current landform acquisition device 96 for acquiring position information on a current landform 800 to be worked by the work implement 1A, the GNSS antennas 14 for acquiring the position of the hydraulic excavator 1 in the global coordinate system, the controller (controller) 40 for controlling the MG, and an input device 52 for inputting signals for switching operation assisting information displayed on the display device 53*a*.

The work implement posture sensor 50 includes the boom angle sensor 30, the arm angle sensor 31, the bucket angle sensor 32, and the machine body tilting angle sensor 33. These angle sensors 30, 31, 32, and 33 function as posture sensors for the work implement 1A, and the machine body, or the upper swing structure 12.

The target surface setter 51 is an interface through which information (inclusive of position information and tilting angle information on each target surface) regarding the target surface 700. The target surface 700 is a surface obtained by extracting and correcting a design surface into a shape suitable for construction. The target surface setter 51 receives three-dimensional data of the target surface defined on the global coordinate system (absolute coordinate system) from an external terminal (not illustrated) through wireless communication or through a storage device (for example, a flash memory or a USB memory). The position information on the target surface 700 is formed based on position information of the design surface which is a final target shape to be formed by excavation work of the hydraulic excavator 1. In the case of excavation work, the target surface 700 is set on or on an upper side of the design surface, and, in the case of embankment work, the target surface is set on or on a lower side of the design surface. Note that inputting of the target surface through the target surface setter 51 may be manually performed by the operator.

As the current landform acquisition device 96, there can be utilized, for example, a stereo camera, a laser scanner, an ultrasonic sensor or the like provided on the excavator 1. These devices are for measuring the distance from the excavator 1 to a point on the current landform, and the current landform acquired by the current landform acquisition device 96 is defined by a huge amount of point group position data. The data in an original form thereof is too much to easily handle, such that the data are appropriately converted into an easily handleable data form in the current landform acquisition device 96. Note that the three-dimensional data on the current landform may be preliminarily acquired by, for example, a drone (unmanned aircraft) with a stereo camera, a laser scanner, an ultrasonic sensor or the like mounted thereon, and the current landform acquisition device 96 may be configured as an interface for taking in the three dimensional data into the controller 40.

The input device 52 is an interface for inputting a signal for switching operation assisting information displayed on the display device 53*a*, to the controller 40. The signal for switching the operation assisting information includes a fourth distance display signal for instructing display of a peripheral excavation depth (fourth distance) which will be described later, and a fifth distance display signal for instructing display of a current landform distance (fifth distance) which will be described later. As a hardware configuration of the input device 52, there can be utilized, for example, one of a switch type for switching ON/OFF of each signal, or one of a touch panel type which is integral with or separate from the display device 53*a*.

The controller 40 includes an input interface 91, a central processing unit (CPU) 92 as a processor, a read only memory (ROM) 93 and a random access memory (RAM) 94 as storage devices, and an output interface 95. Signals from the angle sensors 30 to 32 and the tilting angle sensor 33 as the work implement posture sensor 50, a signal from the target surface setter 51, a signal from the current landform acquisition device 96, signals from the GNSS antennas 14, and a signal from the input device 52 are inputted to the input interface 91, which converts the signals into such a form as to be calculatable by the CPU 92. The ROM 93 is a recording medium in which a control program for executing MG inclusive of processes according to a flow chart to be described later and various kinds of information necessary for execution of the flow chart are stored. The CPU 92 applies predetermined calculation processes to signals taken in from the input interface 91, the ROM 93, and the RAM 94 according to the control program stored in the ROM 93. The output interface 95 forms an output signal according to the results of calculation in the CPU 92, and outputs the signal to the display device 53*a*.

Note that while the controller 40 in FIG. 4 is provided with semiconductor memories of the ROM 93 and the RAM 94 as storage devices, the storage devices may be particularly replaced by other storage devices; for example, a magnetic storage device such as a hard disk drive may be provided.

Figure 5:
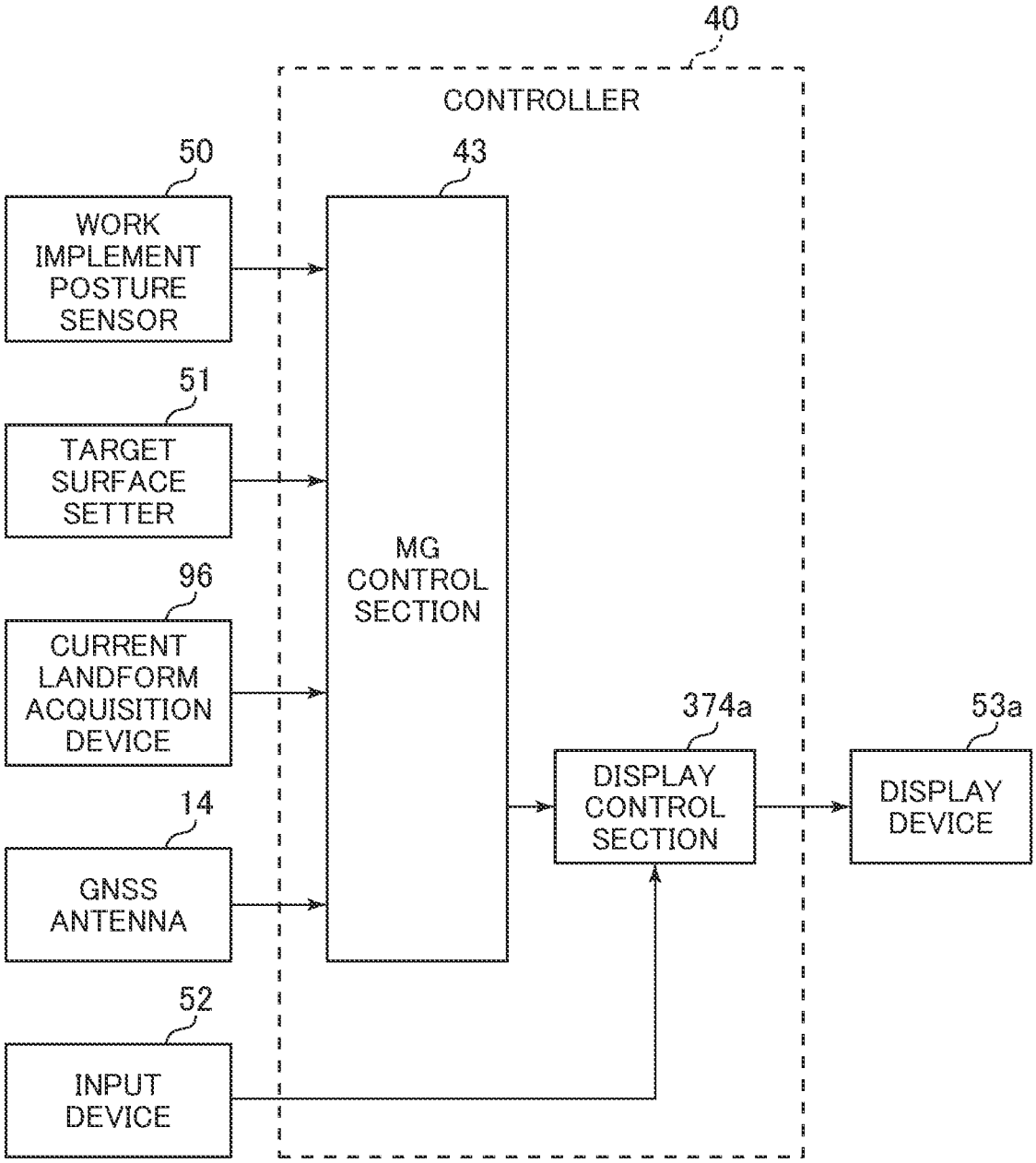
FIG. 5 is a functional block diagram of the controller 40 of the hydraulic excavator.

FIG. 5 is a functional block diagram of the controller 40. The controller 40 includes an MG control section 43 and a display control section 374*a*.

Figure 6:
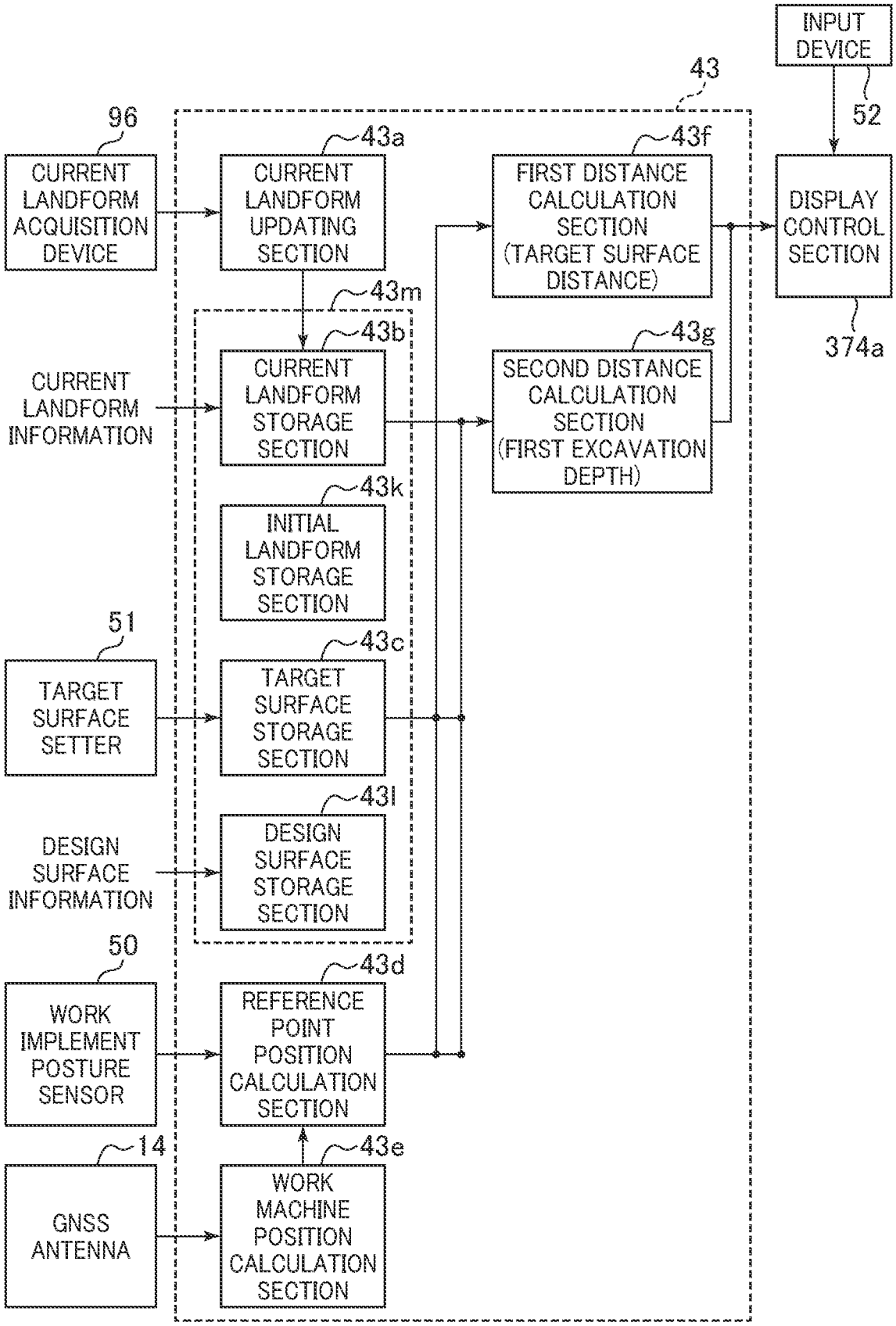
FIG. 6 is a functional block diagram of an MG control section 43 of a first embodiment.

FIG. 6 is a functional block diagram of the MG control section 43 in FIG. 5. The MG control section 43 includes a current landform updating section 43*a*, a storage section 43*m*, a reference point position calculation section 43*d*, a work machine position calculation section 43*e*, a first distance calculation section 43*f*, and a second distance calculation section 43*g*. The storage section 43*m* includes a current landform storage section 43*b*, an initial landform storage section 43*k*, a target surface storage section 43*c*, and a design surface storage section 43*l*.

The current landform storage section 43*b* stores position information (current landform data) on the current landform 800 in the periphery of the hydraulic excavator. For example, the current landform data are acquired by the current landform acquisition device 96 at an appropriate timing in the global coordinate system.

The current landform updating section 43*a* updates the position information on the current landform stored in the current landform storage section 43*b* with the acquired position information on the current landform at an appropriate timing. Specific examples of the method of acquiring the position information on the current landform by the current landform updating section 43*a* includes not only a method by the current landform acquisition device 96, but also trajectory information on a bucket toe calculated by the reference point position calculation section 43*d*.

The target surface storage section 43*c* stores position information (target surface data) on the target surface 700 calculated based on information from the target surface setter 51. In the present embodiment, as depicted in FIG. 4, a sectional shape obtained by cutting the three-dimensional target surface by a plane of movement of the work implement 1A (an operation plane of the work implement) is utilized as the target surface 700 (two-dimensional target surface). Note that the target surface 700 is single in the example of FIG. 4, a plurality of target surfaces different in tilting may be linked. In the case where a plurality of target surfaces are linked, there may be, for example, a method in which a target surface nearest from the work implement 1A is set as the target surface, a method in which a target surface located on a lower side of the bucket toe is set as the target surface, a method in which an arbitrarily selected target surface is set as the target surface, and so on.

The initial landform storage section 43*k* stores position information on the current landform before all the work machines at a site for construction start working (this current landform may be referred to as "initial landform" herein). In other words, the position information on the initial landform is original data of position information on the current landform having not been updated even once by the current landform updating section 43*a*.

The design surface storage section 43*l* stores position information of a design surface which is a final target shape to be formed by excavation work of the hydraulic excavator 1 and which serves as a base in forming the target surface 700. The position information on the design surface is externally inputted, and is stored into the storage section 43*l*. Note that the position information on the target surface 700 is information obtained by extracting and correcting the position information on the design surface in a form suitable for construction.

The work machine position calculation section 43*e* calculates position information (coordinates of a machine body reference position PO as an origin of the excavator coordinate system of FIG. 3) and orientation information of the hydraulic excavator 1 in the global coordinate system, based on information from the pair of GNSS antennas 14, and outputs the data to the reference point position calculation section 43*d*.

The reference point position calculation section (bucket position calculation section) 43*d* calculates position information on a reference point Ps (see FIG. 7) arbitrarily set in the work implement 1A. As depicted in FIG. 7, the reference point Ps in the present embodiment is a center point in the bucket width direction of the toe of the bucket 10, and its position is defined in the global coordinate system. First, the reference point position calculation section 43*d* calculates the posture of the front work implement 1A in the excavator coordinate system (local coordinate system) and the position of the toe of the bucket 10, based on information from the work implement posture sensor 50. As aforementioned, the toe position information (Xbk, Zbk) (bucket position data) of the bucket 10 can be calculated by the formula (1) and formula (2). In addition, coordinate values of the toe (reference point Ps) of the bucket 10 can be converted from the local coordinates to the global coordinates, based on the coordinates of the machine body reference position PO and the machine body tilting angle θ in the global coordinate system and the toe position in the local coordinate system. In the following, an example will be described as a global coordinate system. It is to be noted, however, that the following processes may be conducted in a unified manner in the local coordinate system.

The first distance calculation section 43*f* calculates a first distance D1 (see FIG. 7) that is the distance between the reference point (bucket toe) Ps and the target surface 700 on a virtual straight line Lv (see FIG. 7) extended in a predetermined direction from the reference point Ps toward the target surface 700, based on the position information on the reference point (bucket toe) Ps calculated by the reference point position calculation section 43*d* and the position information on the target surface 700 stored in the target surface storage section 43*c*. The "predetermined direction" of the virtual straight line Lv in the present embodiment is the vertical direction, as depicted in FIG. 7. In other words, the distance between the bucket toe and the target surface 700 on the virtual straight line Lv extended in the vertical direction from the bucket toe is the first distance. Since the first distance D1 indicates the distance from the reference point Ps to the target surface 700, it may be referred to as "target surface distance."

The second distance calculation section 43*g* calculates a second distance D2 (see FIG. 7) that is the distance between the target surface 700 and the current landform 800 on the virtual straight line Lv, based on the position information of the reference point Ps calculated by the reference point position calculation section 43*d*, the position information on the target surface 700 stored in the target surface storage section 43*c*, and the position information on the current landform 800 stored in the current landform storage section 43*b*. Note that the second distance D2, in other words, can be said to be the distance between two points at which the virtual straight line Lv intersects the current landform 800 and the target surface 700. Since the second distance D2 indicates the distance from a ground surface of the current landform 800 to the target surface 700 on the virtual straight line Lv (that is, an excavation depth), it may be referred to as "first excavation depth."

The display control section 374*a* controls the display device 53, based on information inputted from the MG control section 43 and signals inputted from the input device 52. The display controller 374 is provided with a display ROM in which a multiplicity of display-concerned data inclusive of an image and an icon of the work implement 1A are stored, and the display controller 374 reads out a predetermined program based on input information from the MG control section 43, and controls the display on the display device 53. The display control section 374*a* in the present embodiment controls the display device 53, based on the position information on the reference point Ps (bucket toe) and the posture information on the front work implement 1A inputted from the MG control section 43, the position information on the current landform 800 inputted from the current landform storage section 43*b*, the position information on the target surface 700 inputted from the target surface storage section 43*c*, the first distance inputted from the first distance calculation section 43*f*, and the second distance inputted from the second distance calculation section 43*g*. By this, as depicted in FIG. 7, the positional relation between the target surface 700 and the work implement 1A (toe of the bucket 10) is displayed on a display screen of the display device 53*a*, and the first distance D1 and the second distance D2 are displayed on the display screen.

FIG. 7 is an example of the display screen of the display device 53*a* in the present embodiment. On the display screen in FIG. 7 are displayed the bucket 10, the target surface 700 and the current landform 800 in the vicinity of the bucket 10, the first distance D1, and the second distance D2. The first distance D1 and the second distance D2 are displayed in a distance display section 80, the first distance (target surface distance) D1 is displayed as "distance" in the figure, whereas the second distance (first excavation depth) D2 is displayed as "excavation depth" in the figure. Note that while the reference point Ps, the virtual straight line Lv, and dimension lines of the first distance D1 and the second distance D2 are described in the figure, these are for explanation of the figure, and are not displayed on the actual display screen (the same applies also to other figures of display screen). The ranges of the target surface 700 and the current landform 800 to be displayed on the display screen can be set arbitrarily. For example, a method may be adopted in which the target surface 700 and the current landform 800 present in a predetermined range from the reference point Ps are displayed, with the position of the reference point Ps (that is, the position of the bucket toe) as a reference.

—Operation—

Figure 8:
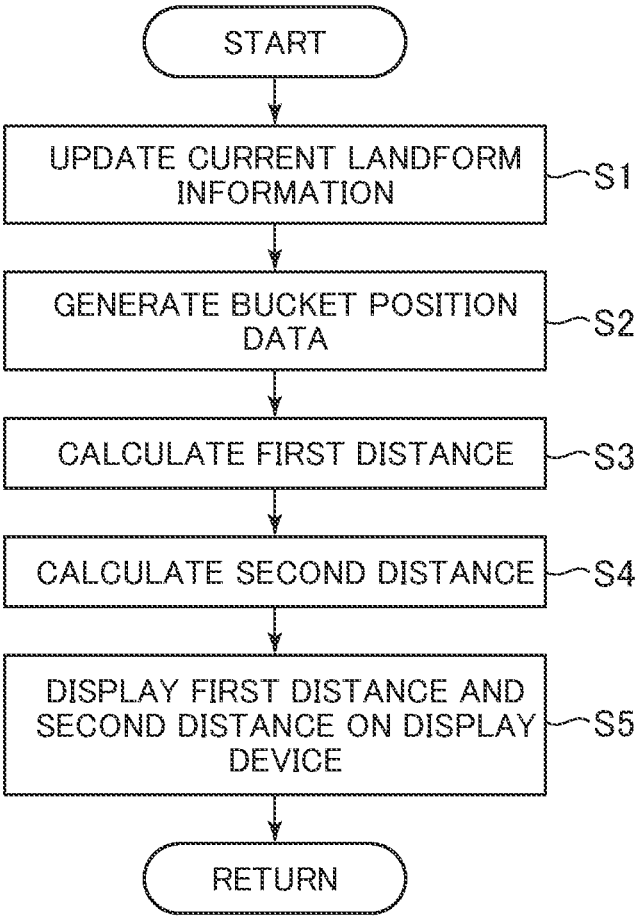
FIG. 8 is a flow chart of MG by the controller 40 of the first embodiment.

An operation of the embodiment configured as above will be described using a flow chart. FIG. 8 is a flow chart of MG by the controller 40 according to the present embodiment. The controller 40 executes the flow chart of FIG. 8 repeatedly at a predetermined control period.

In step S1, the current landform updating section 43*a* acquires position information on a latest current landform from the current landform acquisition device 96, and, by utilizing this, updates the position information on the current landform stored in the current landform storage section 43*b*.

In step S2, the reference point position calculation section 43*d* calculates the coordinates of the bucket toe in the global coordinate system, based on outputs of the work implement posture sensor 50 and the work implement position calculation section 43*e*.

In step S3, the first distance calculation section 43*f* calculates the first distance D1 which is the distance between the bucket toe and the target surface 700 on the virtual straight line Lv, based on the coordinates of the bucket toe calculated by the reference point position calculation section 43*d* and the position information on the target surface 700 stored in the target surface storage section 43*c*.

In step S4, the second distance calculation section 43*g* calculates the second distance D2 which is the distance between the target surface 700 and the current landform 800 on the virtual straight line Lv, based on the coordinates of the bucket toe calculated by the reference point position calculation section 43*d*, the position information on the target surface 700 stored in the target surface storage section 43*c*, and the position information on the current landform 800 stored in the current landform storage section 43*b*.

In step S5, the display control section 374*a* simultaneously displays the first distance D1 calculated in step S3 and the second distance D2 calculated in step S4 in the display section 80 on the screen of the display device 53*a*.

—Advantage—

According to the present embodiment configured as above-mentioned, the second distance (first excavation depth) which is the distance between the current landform 800 and the target surface 700 in the vertical direction from the bucket toe (reference point) is displayed on the display device 53*a*; therefore, the operator can grasp the distance between the current landform 800 and the target surface 700. As a result, even when the bucket 10 is located at a position spaced from the current landform 800, at what extent to the lower side from the current landform 700 the target surface 700 is located can be objectively grasped, and at what extent of speed the front work implement 1A should be operated can be grasped.

Second Embodiment

A second embodiment of the present invention will be described. Here, descriptions of the parts in common with the first embodiment will be omitted, and different parts will mainly be described.

Figure 9:
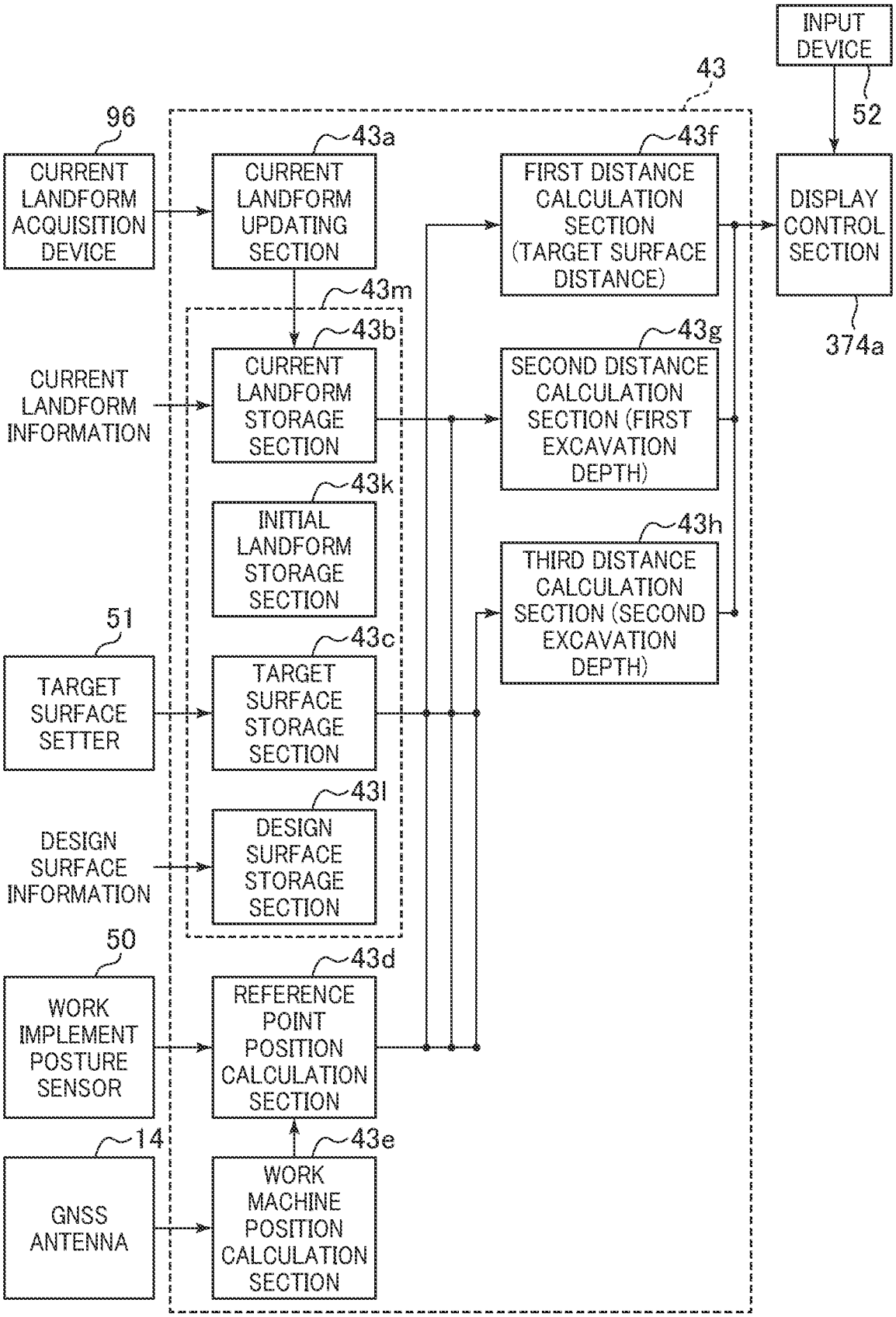
FIG. 9 is a functional block diagram of the MG control section 43 of a second embodiment.

FIG. 9 is a functional block diagram of an MG control section 43 of the second embodiment. The MG control section 43 is provided with a third distance calculation section 43*h*.

In the case where the reference point (bucket toe) Ps is located on the lower side of the current landform 800, the third distance calculation section 43*h* calculates a third distance D3 (see FIG. 11) which is the distance between the reference point Ps and the target surface 700 on the virtual straight line Lv, based on the position information on the reference point Ps calculated by the reference point position calculation section 43*d* and the position information on the target surface 700 stored in the target surface storage section 43*c*. Note that the third distance D3, in other words, can be said to be the distance between an intersection of the virtual straight line Lv with the target surface 700 and the reference point Ps. In the case where the reference point (bucket toe) Ps is located on the lower side of the current landform 800, the third distance D3 indicates the distance from the reference point Ps to the target surface 700 on the virtual straight line Lv (that is, the excavation depth), and, therefore, may be referred to as "second excavation depth." It is to be noted, however, that on a numerical value basis, the third distance D3 is normally coincident with the first distance D1.

Figure 10:
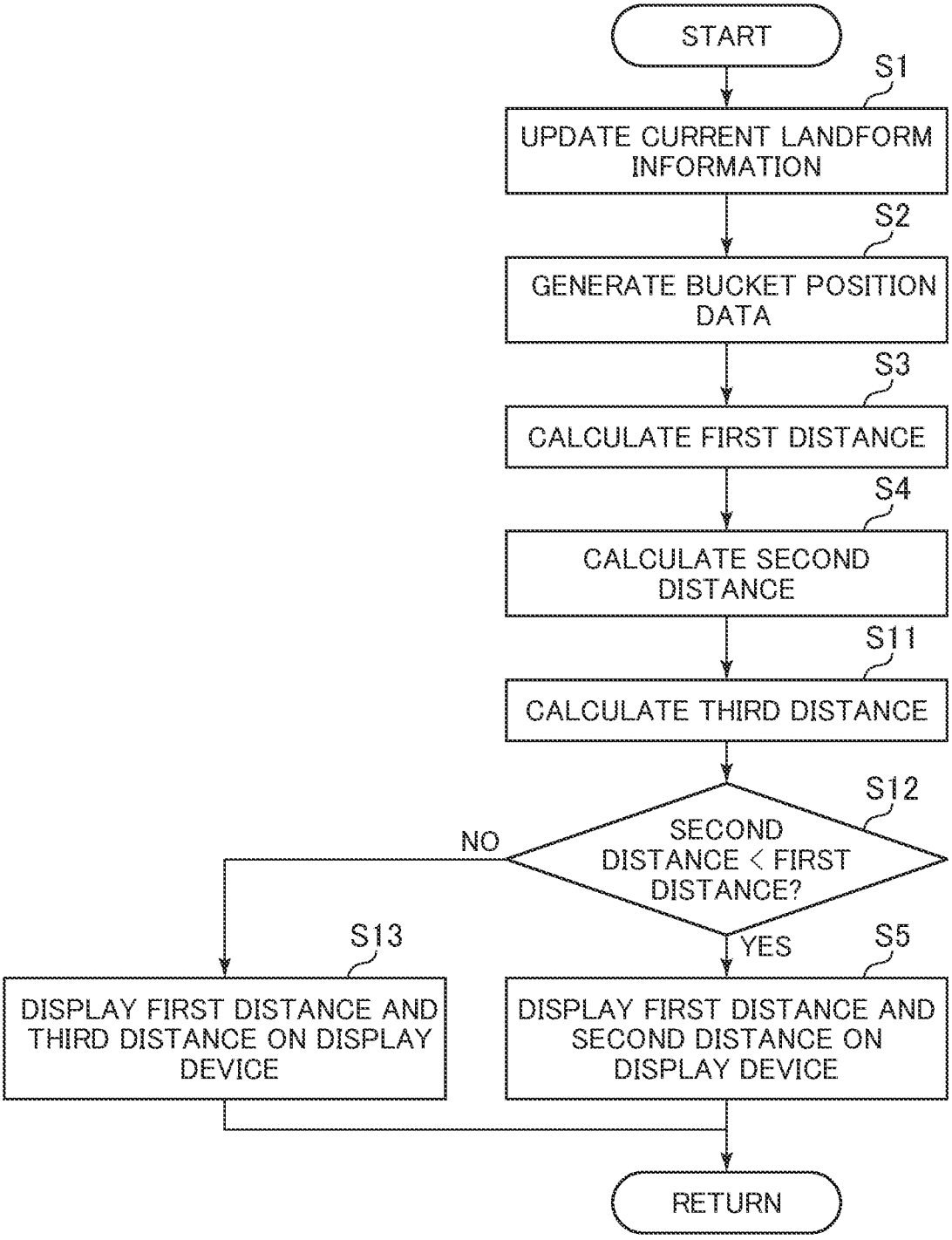
FIG. 10 is a flow chart of MG by a controller 40 according to the second embodiment.

An operation of the present embodiment will be described using a flow chart. FIG. 10 is a flow chart of MG by the controller 40 according to the present embodiment. The controller 40 executes the flow chart of FIG. 10 repeatedly at a predetermined control period. Note that the same processes as those in the flow chart of FIG. 8 are denoted by the same reference characters used above, and descriptions thereof will be omitted.

First, in step S11 subsequent to step S4, the third distance calculation section 43*h* calculates the third distance D3 which is the distance between the bucket toe and the target surface 700 on the virtual straight line Lv, based on the coordinates of the bucket toe calculated by the reference point position calculation section 43*d* and the position information on the target surface 700 stored in the target surface storage section 43*c*.

Figure 11:
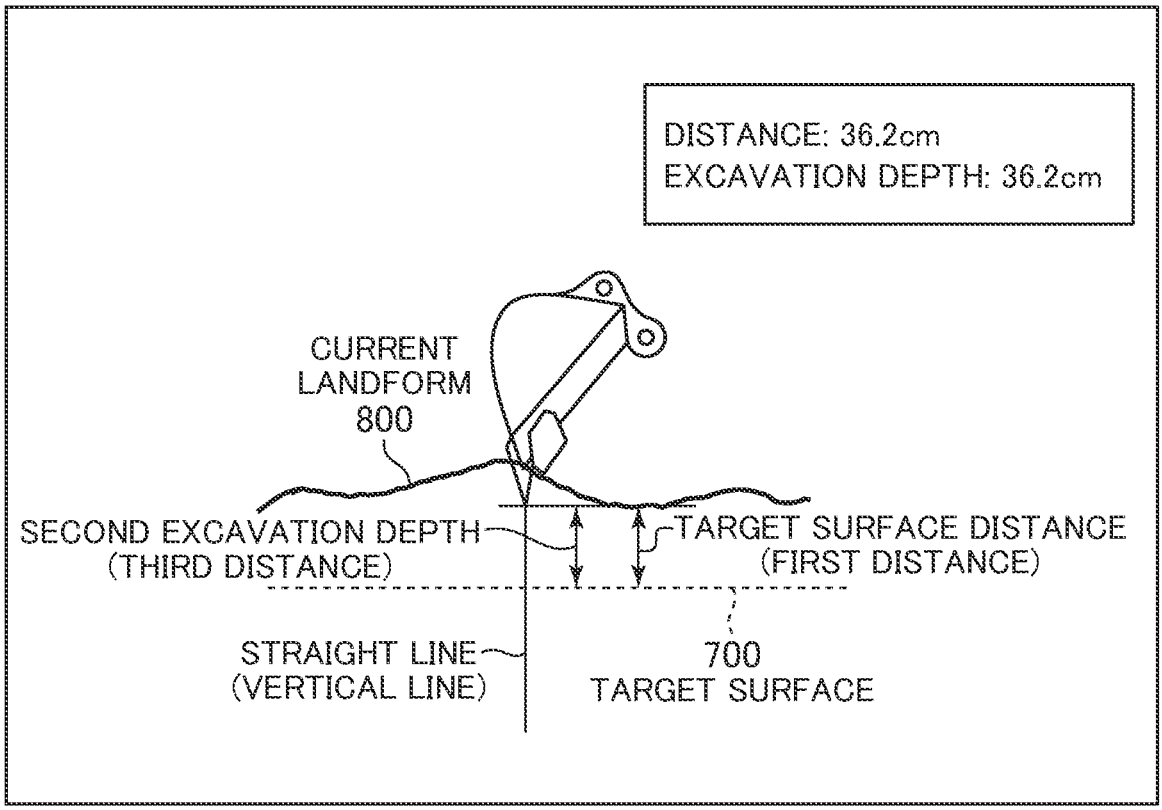
FIG. 11 is an example of a display screen of a display device 53*a* of the second embodiment.

In step S12, the display control section 374*a* compares the magnitudes of the first distance D1 calculated in step S3 and the second distance D2 calculated in step S4. In the case where the first distance D1 is greater than the second distance D2, the display control section 374*a* deems the reference point (bucket toe) Ps as located on the upper side of the current landform 800, and simultaneously displays the first distance D1 and the second distance D2 on the display device 53*a* as depicted in FIG. 7 (step S5). On the other hand, in the case where the second distance D2 is equal to or greater than the first distance D1, the display control section 374*a* deems the reference point (bucket toe) Ps as located on the lower side of the current landform 800, and simultaneously displays the first distance D1 and the third distance D3 in the display section 80 of the display device 53*a* as depicted in FIG. 11 (step S13). In other words, in this case, two equal numerical values are displayed in the display section 80.

—Advantage—

In practice, there is no possibility that the bucket toe might be located on the lower side of the current landform 800 during excavation work. However, on the display screen of the display device 53*a*, if the updating timing of the position information on the current landform 800 by the current landform updating section 43*a* and the calculation timing of the second distance D2 by the second distance calculation section 43*g* are deviated from each other, the bucket toe may be displayed on the lower side of the current landform 800 as depicted in FIG. 11. When the second distance D2 is displayed like in the first embodiment even in such a case, the numerical value of the second distance D2 is greater than that of the actual excavation depth, and, therefore, discomfort may be given to the operator. According to the present embodiment, however, even in the case where such a situation is generated, the operator can accurately grasp the distance between the current landform 800 and the target surface 700. As a result, even if the updating timing of the position information on the current landform 800 and the calculation timing of the second distance D2 are deviated from each other, at what extent to the lower side from the current landform 700 (bucket toe) the target surface 700 is present can be objectively grasped.

Third Embodiment

A third embodiment of the present invention will be described. Here, descriptions of the parts in common with the first and second embodiments will be omitted, and different parts will mainly be described.

Figure 12:
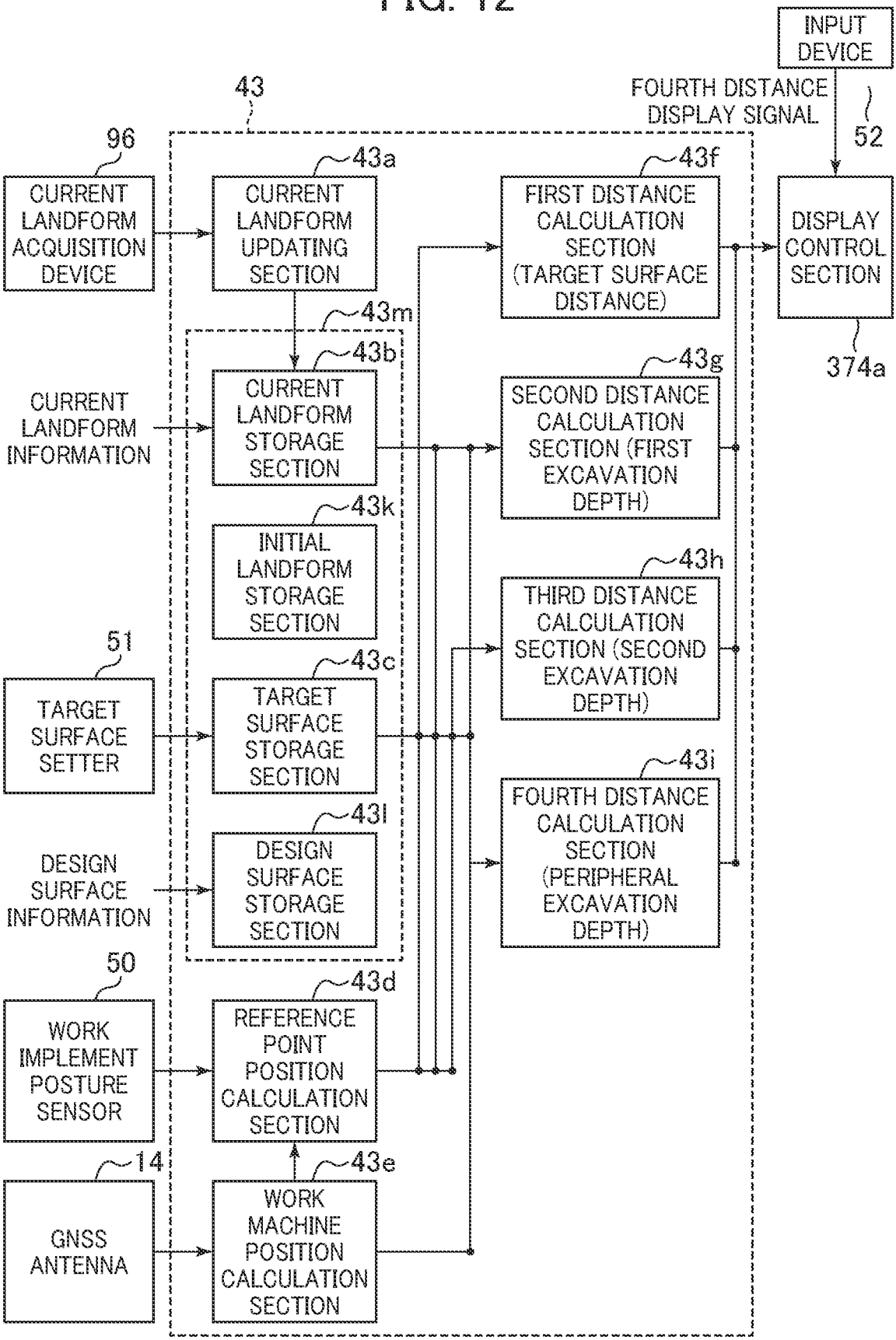
FIG. 12 is a functional block diagram of an MG control section 43 of a third embodiment.

FIG. 12 is a functional block diagram of an MG control section 43 of the third embodiment. The MG control section 43 is provided with a fourth distance calculation section 43*i*.

The fourth distance calculation section 43*i* calculates fourth distances D4 which are a plurality of distances between the target surface 700 and the current landform 800 on virtual straight lines Ls extended in the same vertical direction as in the first embodiment from a plurality of points on the current landform 800 toward the target surface 700, based on the position information on the target surface 700 stored in the target surface storage section 43*c* and the position information on the current landform 800 stored in the current landform storage section 43*b*. In other words, the fourth distances D4 are a set of distances the number of which is the same as the number of the plurality of points set on the current landform 800, and each of the distances included in the set indicates the distance in the vertical direction (predetermined direction) from an arbitrary point on the current landform 800 to the target surface 700. The fourth distances D4 indicate a set of the distances between the current landform 800 and the target surface 700 in the same direction as the inclination of the virtual straight line Lv in the periphery of the work machine (that is, the excavation depths), and, therefore, may be referred to as "peripheral excavation depths."

The input device 52 of the present embodiment is configured to be able to output a signal for instructing display of the peripheral excavation depths (fourth distances) in place of display of FIGS. 7 and 11 in the first and second embodiments (this signal may be referred to as "fourth distance display signal") to the display control section 374*a* in the controller 40. In the case where the fourth distance display signal is not inputted from the input device 52, the display control section 374*a* of the present embodiment controls the display screen of the display device 53*a* according to the flow of the second embodiment, that is, according to FIG. 10.

Figure 13:
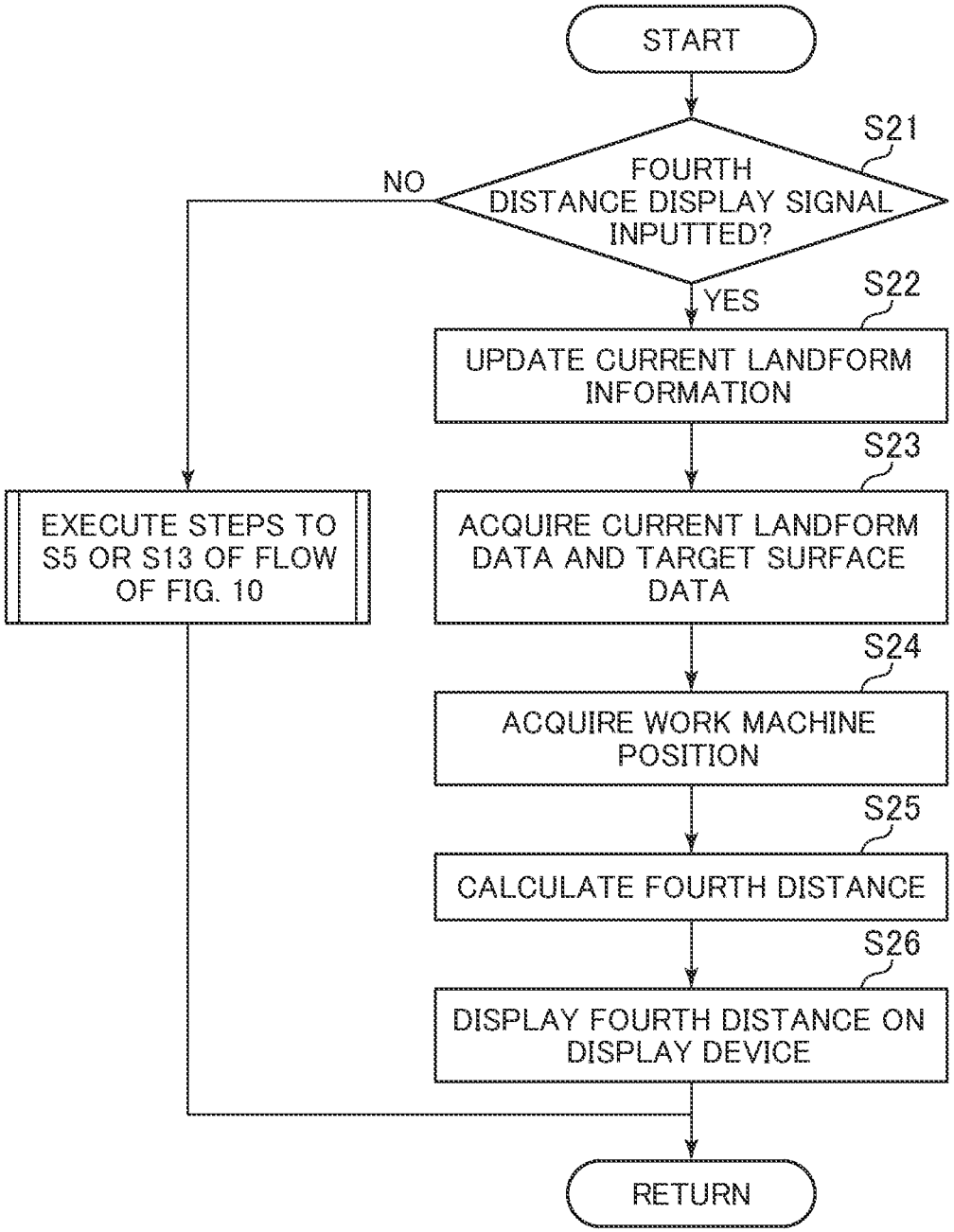
FIG. 13 is a flow chart of MG by a controller 40 of the third embodiment.

An operation of the present embodiment will be described using a flow chart. FIG. 13 is a flow chart of MG by the controller 40 according to the present embodiment. The controller 40 executes the flow chart of FIG. 13 repeatedly at a predetermined control period. Note that the same processes as those in the flow charts of FIGS. 8 and 10 are denoted by the same reference characters as used above, and descriptions thereof may be omitted.

In step S21, the display control section 374*a* determined whether or not the fourth distance display signal is inputted from the input device 52. Here, in the case where it is determined that the fourth distance display signal is not inputted, the flow of FIG. 10 is started from step S1, and the processes of steps ranging to step S5 or step S13 are performed. In other words, in this case, the same display process as that in the second embodiment is performed. On the other hand, in the case where it is determined in step S21 that the fourth distance display signal is inputted, the control proceeds to step S22.

In step S22, the current landform updating section 43*a* acquires position information on the latest current landform from the current landform acquisition device 96, and, by utilizing this, updates the position information on the current landform stored in the current landform storage section 43*b*.

In step S23, a fourth distance calculation section 43*i* acquires the position information on the current landform 800 stored in the current landform storage section 43*b* and the position information on the target surface 700 stored in the target surface storage section 43*c*.

In step S24, the fourth distance calculation section 43*i* acquires the position information and orientation information on the hydraulic excavator 1 in the global coordinate system calculated by the work machine position calculation section 43*e*.

In step S25, the fourth distance calculation section 43*i* calculates the fourth distances D4 by calculating the excavation depths for a plurality of points on the current landform 800 included in a predetermined range, with the position information on the hydraulic excavator acquired in step S24 as a reference. The range in which to calculate the fourth distances D4 may be limited. In the case of limiting the calculation range, the range can be defined, for example, by a predetermined closed region including the position of the hydraulic excavator 1. The predetermined closed region can be defined, for example, by a circle having a predetermined radius with its center located at the position of the hydraulic excavator 1. In addition, for which of the points included in the predetermined closed region the excavation depth should be calculated can be set arbitrarily. For example, a setting may be made in which tetragonal meshes are defined on the current landform 800, and the excavation depth is calculated for the center point of each mesh.

Figure 14:
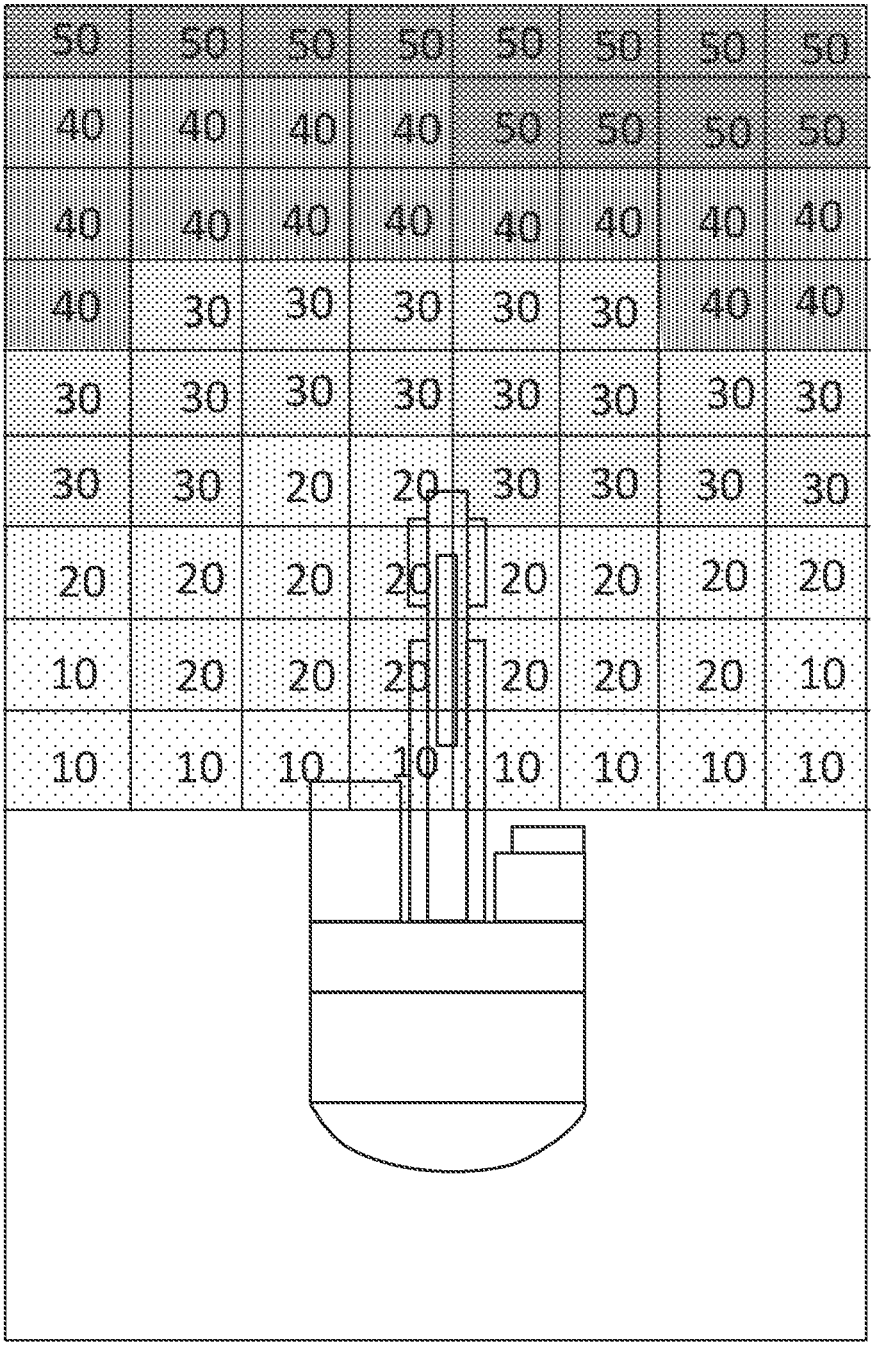
FIG. 14 is an example of the display screen at the time of displaying a fourth distance D4 on the display device 53*a*.

FIG. 14 is an example of a display screen at the time of displaying the fourth distances D4 on the display device 53*a*. In the example of this figure, the current landform 800 is divided in tetragonal meshes, the excavation depth for the center point of each mesh is calculated by the fourth distance calculation section 43*i*, and numerical values obtained by rounding up the unit's place of calculated values are displayed on the plan view. The unit of the numerical value in each tetragonal mesh of FIG. 14 is centimeter, like in FIGS. 7 and 11. It is to be noted, however, that the rounding off at the time of displaying the fourth distances D4 is not indispensable. In addition, in the example of FIG. 14, from the viewpoint of facilitating visual understanding of the excavation depths, the background pattern of each mesh is changed according to the numerical value of the excavation depth in the mesh. It is to be noted that the change of the background pattern according to the numerical value of the depth may not necessarily be made.

—Advantage—

According to the present embodiment configured as above-mentioned, the operator can easily grasp the excavation depth in the periphery of the hydraulic excavator 1. As a result, at what extent to the lower side from the current landform 700 the target surface 700 is present in the periphery of the hydraulic excavator 1 can be objectively grasped, and at what extent of speed the front work implement 1A should be operated can be grasped.

—Modification—

Figure 15:
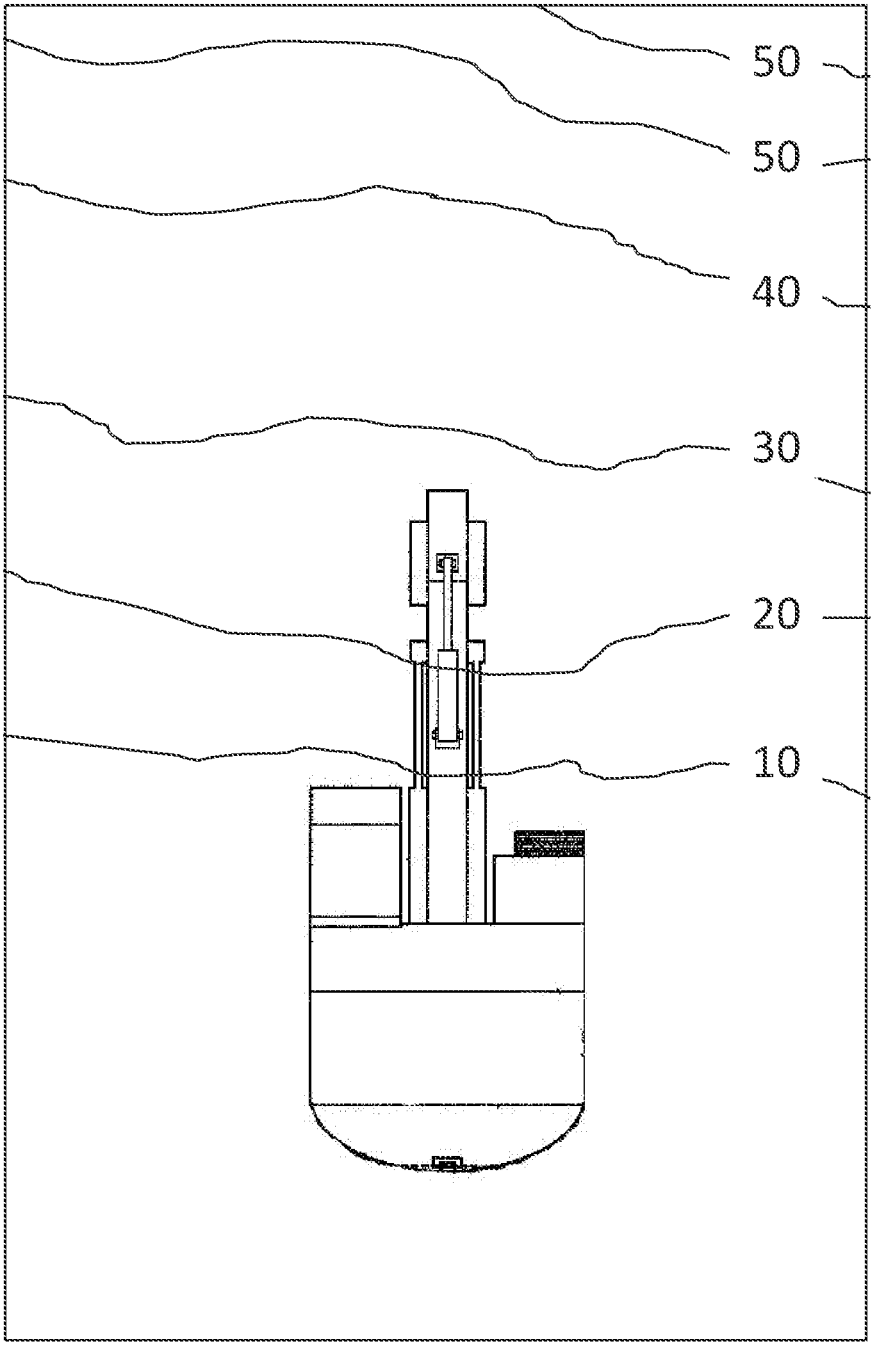
FIG. 15 is an example of the display screen at the time of displaying the fourth distance D4 on the display device 53*a*.

FIG. 15 is an example of a display screen at the time of displaying the fourth distances D4 on the display device 53*a*. In the example of this figure, the excavation depth at each point on the current landform 800 is calculated by the fourth distance calculation section 43*i*, the calculated values are plotted on the current landform 800, and the points of the same excavation depth are interconnected by lines (contour lines), to thereby represent the fourth distances D4. The numerical values inserted between the lines in the figure indicate the excavation depths, and the unit of the numerical values is centimeter. Where the fourth distances D4 are displayed in this way, also, the same advantage as that in FIG. 14 can be obtained.

Fourth Embodiment

A fourth embodiment of the present invention will be described. Here, descriptions of the parts in common with the first, second, and third embodiments will be omitted, and different parts will mainly be described.

Figure 16:
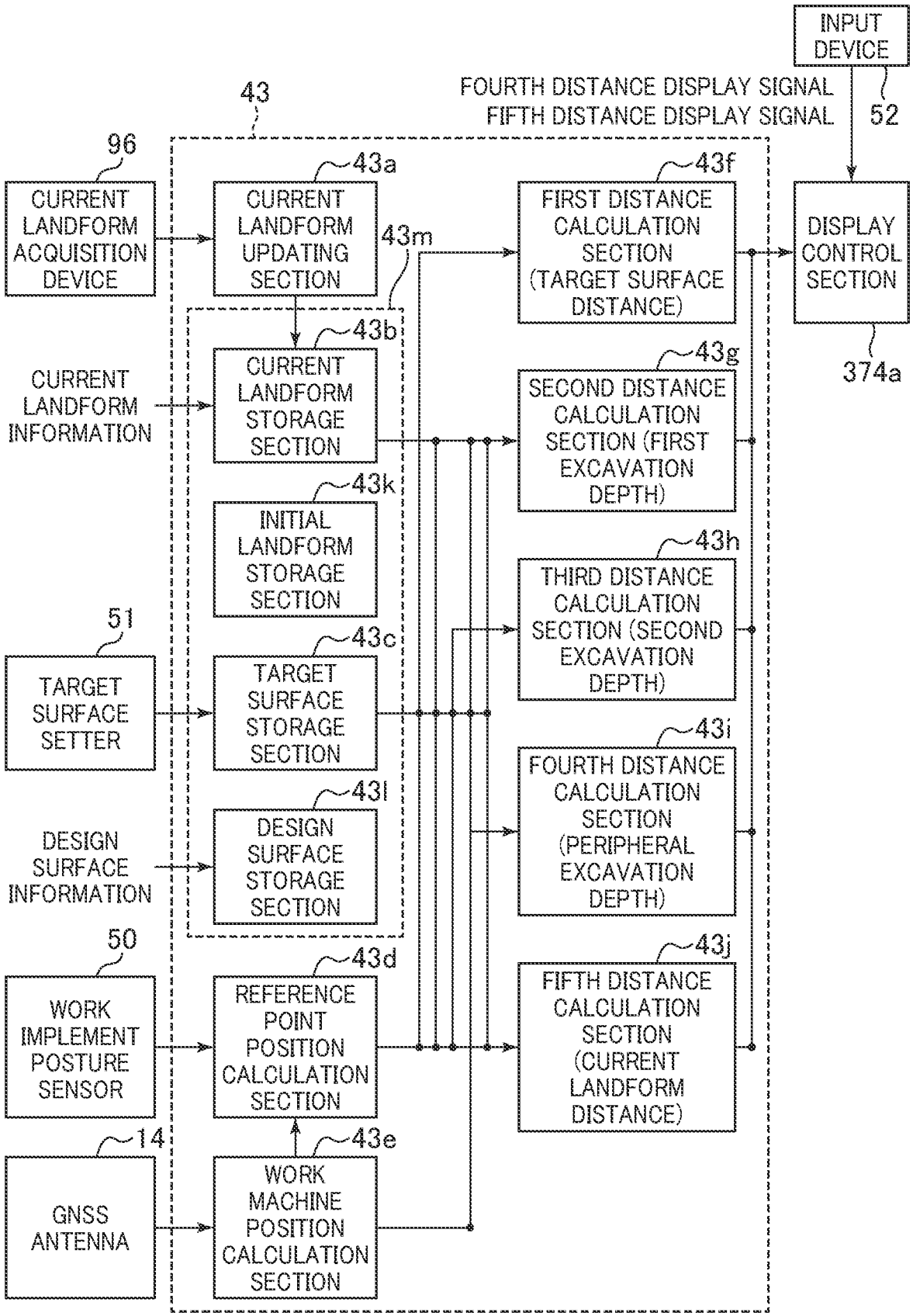
FIG. 16 is a functional block diagram of an MG control section 43 of a fourth embodiment.

FIG. 16 is a functional block diagram of an MG control section 43 of the fourth embodiment. The MG control section 43 is provided with a fifth distance calculation section 43*j*.

In the case where the reference point (bucket toe) Ps calculated by the reference point position calculation section 43*d* is located on the upper side of the current landform 800, the fifth distance calculation section 43*j* calculates a fifth distance D5 which is the distance between the reference point (bucket toe) Ps and the current landform 800 on the virtual straight line Lv, based on the position information on the reference point Ps calculated by the reference point position calculation section 43*d*, the position information on the target surface 700 stored in the target surface storage section 43*c*, and the position information on the current landform 800 stored in the current landform storage section 43*b*. In other words, the distance between the bucket toe and the current landform 800 on the virtual straight line Lv extended in the vertical direction from the bucket toe is the fifth distance. The fifth distance D5 indicates the distance from the reference point Ps to the current landform 800, and, therefore, it may be referred to as "current landform distance." On a numerical value basis, the fifth distance D5 is a value obtained by subtracting the second distance D2 from the first distance D1; therefore, the value obtained by subtracting the second distance D2 from the first distance D1 may be calculated as the fifth distance D5.

The input device 52 of the present embodiment is configured to be able to output a signal for instructing display of the fifth distance D5 in addition to the display in FIGS. 7 and 11 in the first and second embodiments (this signal may be referred to as "fifth distance display signal") to the display control section 374*a* in the controller 40. In the case where the fifth distance display signal is not inputted from the input device 52, the display control section 374*a* of the present embodiment controls the display screen of the display device 53*a* according to the flow of the third embodiment, that is, according to FIG. 13.

Figure 17:
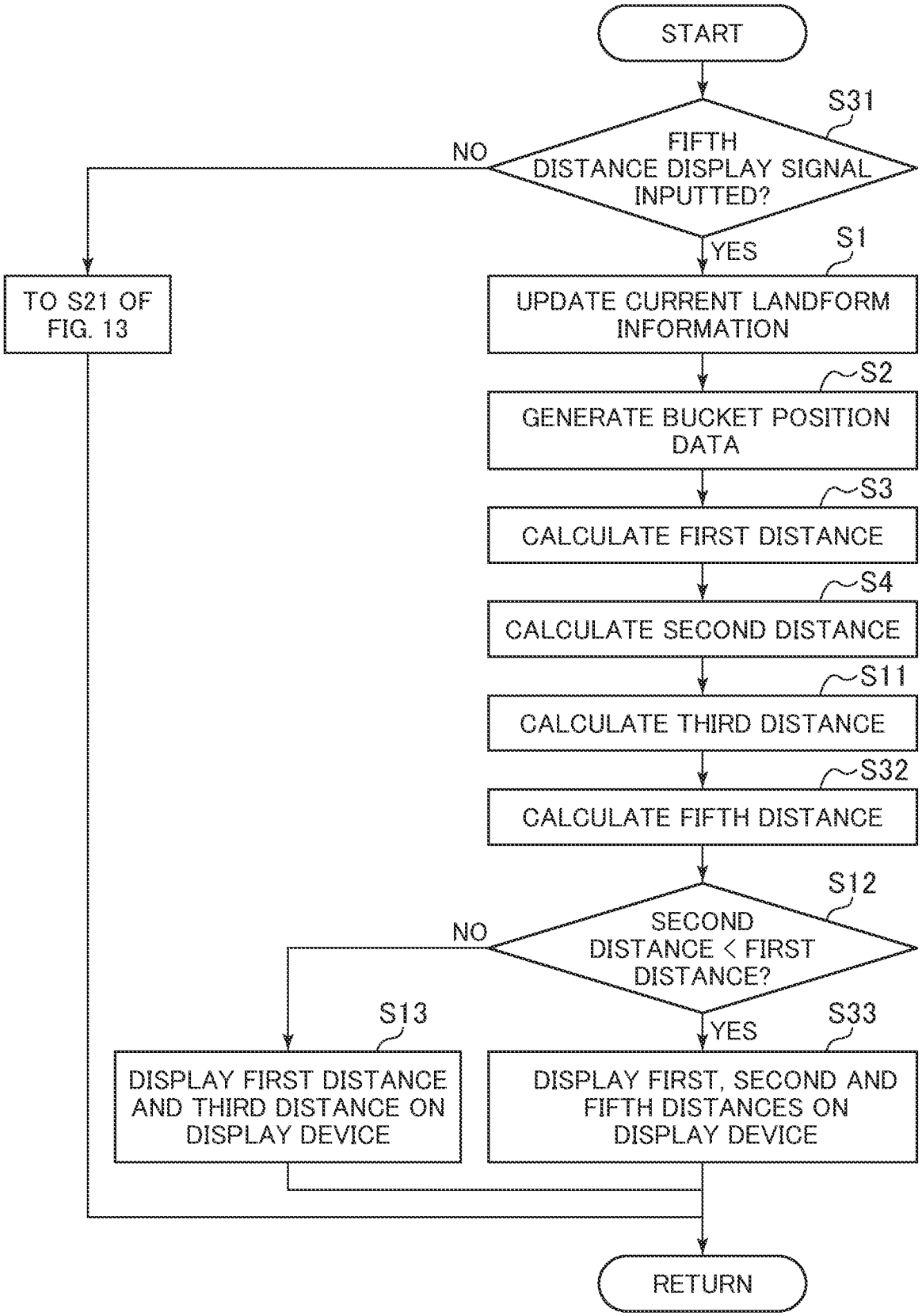
FIG. 17 is a flow chart of MG by a controller 40 according to the fourth embodiment.

An operation of the present embodiment will be described using a flow chart. FIG. 17 is a flow chart of MG by the controller 40 according to the present embodiment. The controller 40 executes the flow chart of FIG. 17 repeatedly at a predetermined control period. Note that the same processes as those in the flow charts of FIGS. 8, 10, and 13 are denoted by the same reference characters as used above, and descriptions thereof may be omitted.

In step S31, the display control section 374*a* determines whether or not the fifth distance display signal is inputted from the input device 52. Here, in the case where it is determined that the fifth distance display signal is not inputted, the flow of FIG. 13 is started from step S21, and processes of the steps ranging to step S5 (FIG. 10) or step S13 (FIG. 10) or step S25 (FIG. 13) are performed. In other words, in this case, the same display process as that in the third embodiment is conducted. On the other hand, in the case where it is determined in step S31 that the fifth distance display signal is inputted, the control proceeds to step S1. Note that descriptions of steps S1 to S11 are omitted.

In step S32, the fifth distance calculation section 43*j* calculates the fifth distance D5 which is the distance between the bucket toe and the current landform 800 on the virtual straight line Lv, based on the coordinates of the bucket toe calculated by the reference point position calculation section 43*d* and the position information on the current landform 800 stored in the current landform storage section 43*b*.

Figure 18:
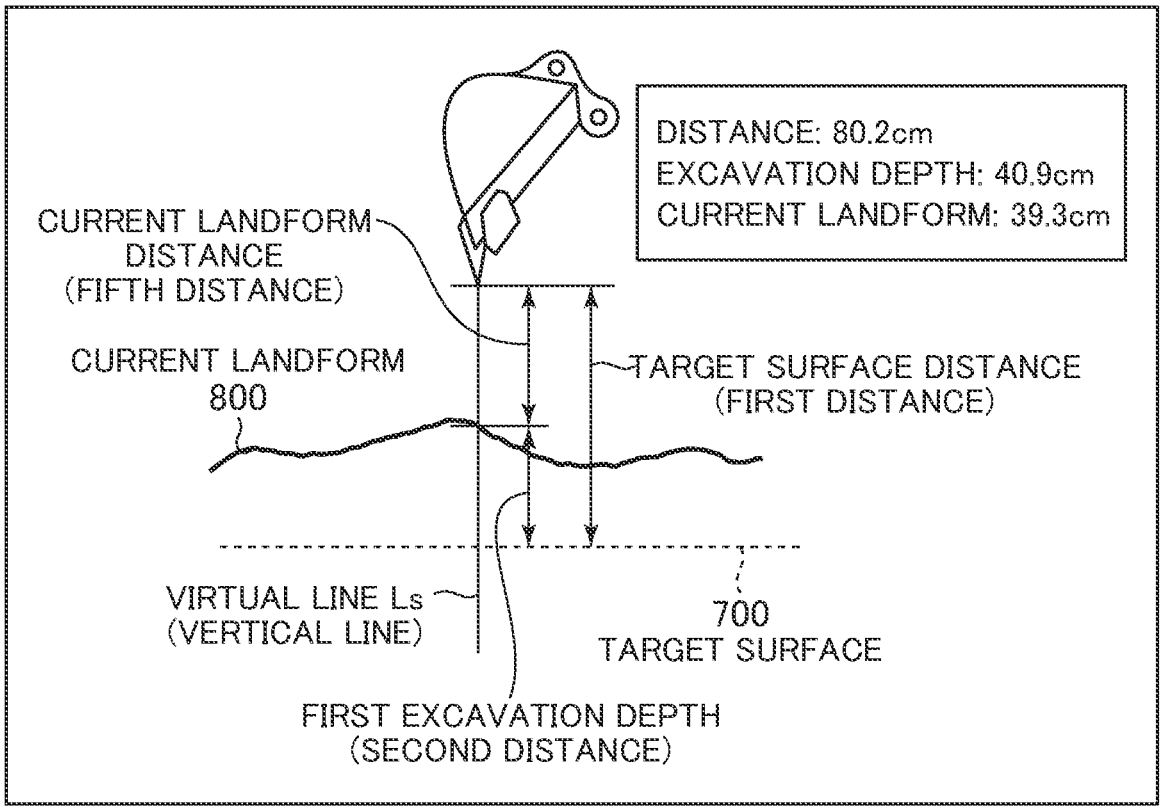
FIG. 18 is an example of a display screen of a display device 53*a* of the fourth embodiment.

In step S12, the display control section 374*a* compares the magnitudes of the first distance D1 calculated in step S3 and the second distance D2 calculated in step S4. In the case where the first distance D1 is greater than the second distance D2, the display control section 374*a* deems the reference point (bucket toe) Ps as located on the upper side of the current landform 800, and simultaneously displays the first distance D1 and the second distance D2 and the fifth distance D5 on the display device 53*a* as depicted in FIG. 18 (step S33). On the other hand, in the case where the second distance D2 is equal to or greater than the first distance D1, the display control section 374*a* deems the reference point (bucket toe) Ps as located on the lower side of the current landform 800, and displays the first distance D1 and the third distance D3 in the display section 80 of the display device 53*a* as depicted in FIG. 11 (step S13).

—Advantage—

According to the present embodiment configured as above-mentioned, the fifth distance (current landform distance) which is the distance from the bucket toe (reference point) to the current landform 800 in the vertical direction is displayed on the display device 53*a*, and, therefore, the operator can grasp the distance between the bucket toe and the current landform 800. As a result, at what extent to the lower side from the bucket toe the current landform 800 is present can be objectively grasped, and at what extent of speed the front work implement 1A should be operated can be grasped.

—Modification—

Note that while in the above-described example, all the first distance D1, the second distance D2, and the fifth distance D5 have been displayed when the control proceeds to step S33, the second distance D2 may be non-displayed. In addition, a configuration may be adopted in which whether or not the second distance D2 is to be non-displayed can be selected by the input device 52.

<Others>

—Reference Point—

In each of the above-described embodiments, the reference point on the work machine side at the time of calculating the first, second, third, and fifth distances (the reference point in the reference point position calculation section 43*d*) has been set at the toe of the bucket 10 (the tip of the work implement 1A), but the reference point Ps can be arbitrarily set on the work implement 1A. In addition, the reference point need not be always set at the same point, and, for example, a configuration may be adopted in which the reference point Ps moves according to the posture of the work implement 1A. For instance, a bottom surface of the bucket 10 or an outermost portion of a bucket link 13 can be selected as the reference point, or a configuration may be adopted in which a point on the bucket 10 which point is nearest to the target surface 700 is appropriately set to be a control point.

—Direction (Inclination) of Virtual Straight Line—

Figure 19:
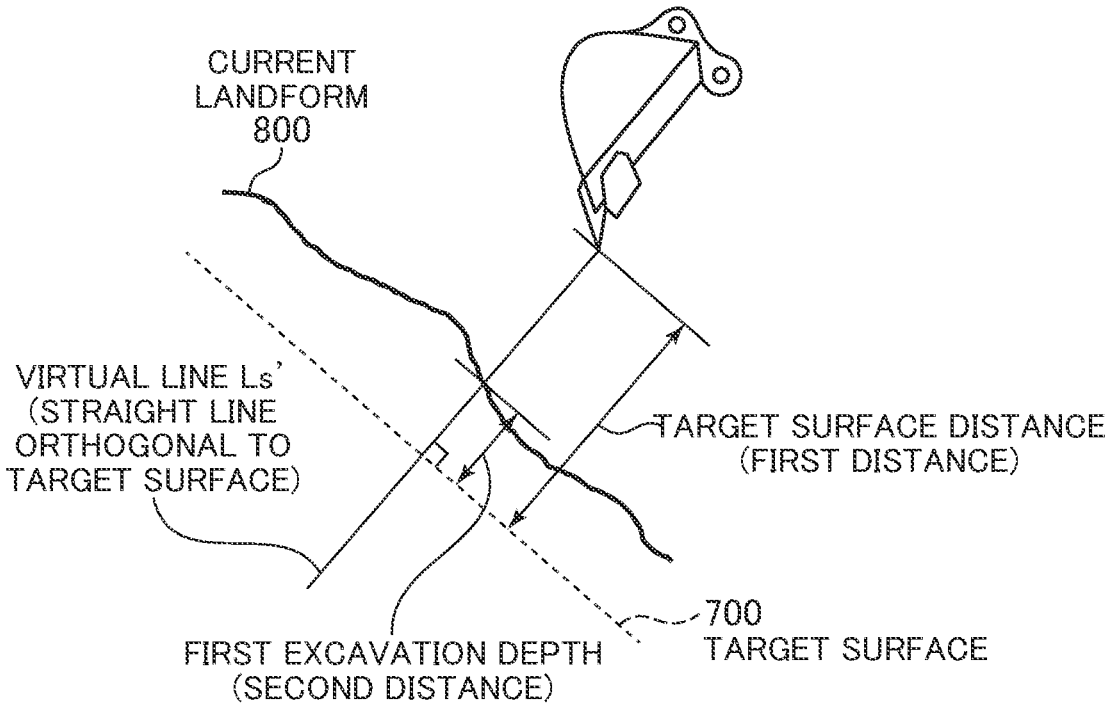
FIG. 19 is an example in which a straight line passing through a reference point (bucket toe) Ps and being orthogonal to a target surface 700 is made to be a virtual straight line Lv'.

Besides, in each of the above-described embodiments, the straight line extended in the vertical direction from the reference point (bucket toe) Ps has been defined as the virtual straight line Lv; however, the direction in which to extend the straight line from the reference point Ps can be set arbitrarily, and a straight line extended in a direction other than the vertical direction may be set to be the virtual straight line. For example, in the example of FIG. 19, the straight line passing through the reference point (bucket toe) Ps and being orthogonal to the target surface 700 is set as the virtual straight line Lv'. Where each of the distances D1 to D5 is set in this way, also, the present invention can produce its advantage.

—Updating of Position Information on Current Landform by Trajectory of Reference Point—

In addition, in each of the above-described embodiments, at the time of updating the position information on the current landform 800, the latest information has been acquired from the output of the current landform acquisition device 96; however, the position information on the current landform 800 may be updated utilizing the position information on the bucket toe to be calculated by the reference point position calculation section 43*d*. In this case, the position information on the current landform 800 stored in the current landform storage section 43*b* and the position information on the bucket toe to be calculated by the reference point position calculation section 43*d* are inputted at the current landform updating section 43*a*. Then, the current landform updating section 43*a* compares the vertical levels of the position of the bucket toe and the current landform. In the case where the position of the bucket toe calculated by the reference point position calculation section 43*d* is determined to be on the lower side relative to the position of the current landform stored in the current landform storage section 43*b*, the position information on the current landform stored in the current landform storage section 43*b* is updated with the position information on the bucket toe calculated by the reference point position calculation section 43*d*. On the other hand, in the case where the position information on the bucket toe calculated by the reference point position calculation section 43*d* is determined to be on the upper side relative to the position of the current landform stored in the current landform storage section 43*b*, the updating of the current landform stored in the current landform storage section 43*b* is not performed. In other words, here, the trajectory of the bucket toe at the time of excavation of the current landform 800 is deemed as the current landform 800 after excavation, to thereby update the current landform data.

Figure 20A:
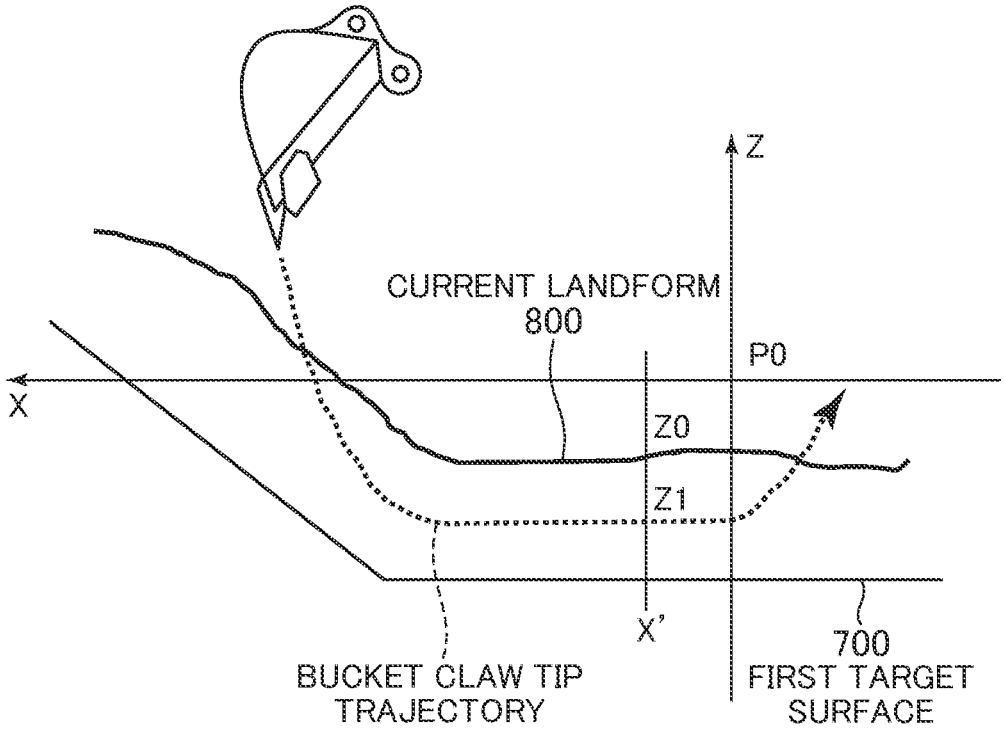
FIG. 20A is a schematic view depicting updating of a current landform by a current landform updating section 43*a* based on position information on a bucket toe.
Figure 20B:
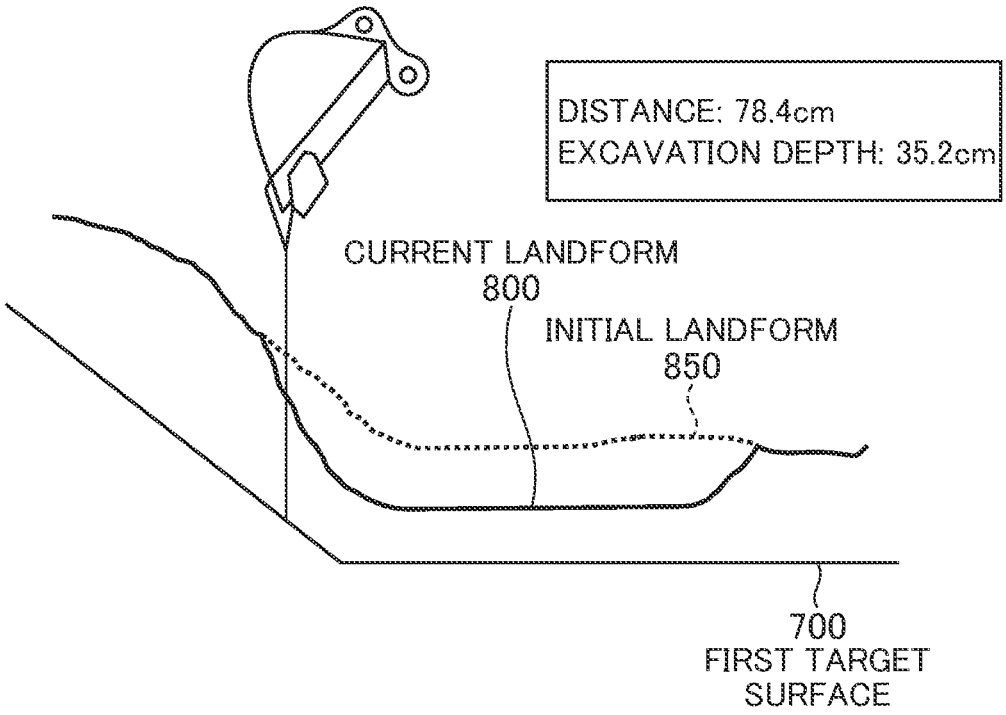
FIG. 20B is an example of a display screen of the display device 53*a* after updating of the current landform by the current landform updating section 43*a* based on FIG. 20A.

FIG. 20A depicts a schematic view depicting the updating of the current landform by the current landform updating section 43*a* based on the position information on the bucket toe. A coordinate z1 in the height direction of the bucket at a certain horizontal coordinate x' is compared with a coordinate z0 in the height direction of the current landform, and, if z1 is on the lower side relative to z0, updating is conducted using z1 as new current landform data. FIG. 20B is an example of the display screen of the display device 53*a* after the updating of the current landform by the current landform updating section 43*a* based on FIG. 20A.

Where the position information on the bucket toe is thus utilized for updating the current landform, it is unnecessary for the current landform acquisition device 96 to acquire the current landform data each time of excavation, and the time required for acquiring the current landform data can be shortened. In addition, once the current landform data are acquired, the current landform data are thereafter sequentially updated by the updating function of the current landform updating section 43*a*, and, therefore, mounting of the current landform acquisition device 96 on the hydraulic excavator 1 can be omitted.

—Display of Initial Landform—

Incidentally, in the example of FIG. 20B, the display control section 374*a* reads out the position information on an initial landform 850 from the initial landform storage section 43*k*, and displays it together with the position information on the current landform 800 after updating. Where the initial landform 850 and the current landform 800 are simultaneously displayed in this way, the progress of work from the start of the work can be easily grasped. Note that the simultaneous display of the initial landform 850 and the current landform 800 can naturally be applied in each of the above-described embodiments.

—Supplement—

Each configuration concerning the controller 40 and the functions, processes and the like of each configuration may partially or entirely be realized by hardware (for example, by designing the logics for executing each of the functions with integrated circuit, or the like). In addition, the configuration concerning the controller 40 may be a program (software) such as to be read out and executed by an arithmetic processor (for example, CPU) thereby realizing each of the functions concerning the controller 40. The information concerning the program can be stored, for example, in a semiconductor memory (flash memory, SSD, etc.), a magnetic storage device (hard disk drive, etc.), a recording medium (magnetic disk, optical disk, etc.) or the like.

Note that the present invention is not limited to the above-described embodiments, and includes various modifications within the scope of the gist thereof. For example, the present invention is not limited to one including all the configurations described in the above embodiments, but includes those in which the configurations are partly omitted.

DESCRIPTION OF REFERENCE CHARACTERS

1A: Front work implement
8: Boom
9: Arm

10: Bucket
14: GNSS antenna
30: Boom angle sensor
31: Arm angle sensor
32: Bucket angle sensor
40: Controller (controller)
43: MG control section
43*a*: Current landform updating section
43*b*: Current landform storage section (storage section)
43*c*: Target surface storage section (storage section)
43*d*: Reference point position calculation section
43*e*: Work machine position calculation section
43*f*: First distance calculation section
43*g*: Second distance calculation section
43*h*: Third distance calculation section
43*i*: Fourth distance calculation section
43*j*: Fifth distance calculation section
43*k*: Initial landform storage section (storage section)
431: Design surface storage section (storage section)
43*m*: Storage section
50: Work implement posture sensor
51: Target surface setter
52: Input device
53*a*: Display device
96: Current landform acquisition device
374*a*: Display control section

The invention claimed is:

1. A work machine comprising:

a work implement;

a controller including a storage section in which position information on an arbitrarily set target surface is stored, and a reference point position calculation section that calculates position information on a reference point arbitrarily set in the work implement; and a display device that displays a positional relation between the target surface and the work implement based on the position information on the target surface and the position information on the reference point, wherein position information on a current landform is stored in the storage section, the controller further includes a first distance calculation section calculating a first distance that is a distance between the reference point and the target surface on a virtual straight line extended in a predetermined direction from the reference point toward the target surface, based on the position information on the reference point and the position information on the target surface, and a second distance calculation section calculating a second distance that is a distance between the target surface and the current landform on the virtual straight line, based on the position information on the reference point and the position information on the target surface and the position information on the current landform, and the first distance and the second distance are displayed on the display device.

2. The work machine according to claim 1, wherein the controller further includes a third distance calculation section calculating a third distance that is a distance between the reference point and the target surface on the virtual straight line, based on the position information on the reference point and the position information on the target surface, in a case where the reference point is present on a lower side of the current landform, and the first distance and the second distance are displayed on the display device in a case where the reference point is present on an upper side of the current landform, and the first distance and the third distance are displayed on the display device in a case where the reference point is present on the lower side of the current landform.

3. The work machine according to claim 1, wherein the controller further includes a fourth distance calculation section calculating fourth distances that are a plurality of distances between the target surface and the current landform on a plurality of virtual straight lines extended in the predetermined directions from a plurality of points on the current landform toward the target surface, based on the position information on the target surface and the position information on the current landform, and the fourth distances are displayed on the display device.

4. The work machine according to claim 1, wherein the controller further includes a current landform updating section that compares vertical levels of the position information on the reference point calculated by the reference point position calculation section and the position information on the current landform, and updates the position information on the current landform stored in the storage section with the position information on the reference point calculated by the reference point position calculation section in a case where the position information of the reference point is present on a lower side relative to the position information on the current landform.

5. The work machine according to claim 1, wherein position information on an initial landform is further stored in the storage section, and the current landform and the initial landform are displayed on the display device.

6. The work machine according to claim 1, wherein position information on a design surface is stored in the storage section, and the position information on the target surface is formed based on the position information on the design surface.

7. The work machine according to claim 1, wherein the controller includes a fifth distance calculation section calculating a fifth distance that is a distance between the reference point and the current landform on the virtual straight line, based on the position information on the reference point and the position information on the target surface and the position information on the current landform, in a case where the reference point is present on an upper side of the current landform, and the first distance and the fifth distance are displayed on the display device in a case where the reference point is present on the upper side of the current landform.

* * * * *